US010239715B2

(12) United States Patent
Suzuki et al.

(10) Patent No.: US 10,239,715 B2
(45) Date of Patent: Mar. 26, 2019

(54) SHEET FOLDING METHOD, IMAGE FORMING SYSTEM, AND SHEET FOLDING DEVICE WITH MOTOR EMPLOYING BEING CONTROLLED TO PERFORM A FEEDBACK CONTROL WITH AN INTEGRAL GAIN

(71) Applicants: Michitaka Suzuki, Kanagawa (JP); Tomohiro Furuhashi, Kanagawa (JP); Yuuki Nakagawa, Kanagawa (JP); Tomomichi Hoshino, Kanagawa (JP)

(72) Inventors: Michitaka Suzuki, Kanagawa (JP); Tomohiro Furuhashi, Kanagawa (JP); Yuuki Nakagawa, Kanagawa (JP); Tomomichi Hoshino, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/599,645

(22) Filed: May 19, 2017

(65) Prior Publication Data

US 2017/0341885 A1 Nov. 30, 2017

(30) Foreign Application Priority Data

May 27, 2016 (JP) ..... 2016-106312

(51) Int. Cl.
*B65H 5/06* (2006.01)
*B65H 7/14* (2006.01)
(Continued)

(52) U.S. Cl.
CPC ..... *B65H 5/06* (2013.01); *B65H 7/14* (2013.01); *B65H 7/20* (2013.01); *B65H 29/125* (2013.01);
(Continued)

(58) Field of Classification Search
CPC ... B65H 5/06; B65H 7/14; B65H 7/20; B65H 37/06
See application file for complete search history.

(56) References Cited

U.S. PATENT DOCUMENTS 7,334,787 B2 * 2/2008 Akiyama ..... B65H 3/0669 271/10.02
7,415,239 B2 * 8/2008 Saito ..... B41J 13/0063 271/270
(Continued)

FOREIGN PATENT DOCUMENTS

JP 2004-185056 7/2004
JP 2014-101164 6/2014
(Continued)

*Primary Examiner* — Patrick H Mackey
(74) *Attorney, Agent, or Firm* — Harness, Dickey & Pierce, P.L.C.

(57) ABSTRACT

A sheet folding device, which is included in an image forming system and uses a sheet folding method, includes first and second drive motors, a first sheet conveyor driven by the first drive motor and configured to receive and convey a sheet toward a downstream side of a sheet conveying direction, a second sheet conveyor driven by the second drive motor and configured to receive the sheet conveyed from the first sheet conveyor and to convey the sheet to the downstream side of the sheet conveying direction, and a controller configured to fold the sheet to a predetermined folding length set according to an amount of conveyance of the sheet by the second sheet conveyor while the sheet is being held between the first and second sheet conveyors, and to perform a feedback control with an integral gain to the second drive motor.

22 Claims, 13 Drawing Sheets

(51) Int. Cl.

| | |
|---|---|
| ***B65H 7/20*** | (2006.01) |
| ***B65H 29/12*** | (2006.01) |
| ***B65H 43/08*** | (2006.01) |
| ***B65H 45/14*** | (2006.01) |
| *B65H 5/00* | (2006.01) |

(52) U.S. Cl.
CPC ..... *B65H 43/08* (2013.01); *B65H 45/14* (2013.01); *B65H 5/00* (2013.01); *B65H 2403/942* (2013.01); *B65H 2511/11* (2013.01); *B65H 2513/412* (2013.01); *B65H 2701/1311* (2013.01); *B65H 2701/1313* (2013.01); *B65H 2801/27* (2013.01)

(56) References Cited

U.S. PATENT DOCUMENTS

| | | | | |
|---|---|---|---|---|
| 2007/0126171 | A1* | 6/2007 | Takeuchi ..... | B65H 3/5261 271/121 |
| 2014/0141956 | A1* | 5/2014 | Suzuki ..... | B65H 45/14 493/454 |
| 2014/0147184 | A1 | 5/2014 | Kunieda et al. | |
| 2014/0336031 | A1* | 11/2014 | Suzuki ..... | B65H 45/04 493/442 |
| 2015/0353315 | A1 | 12/2015 | Suzuki et al. | |
| 2015/0360892 | A1* | 12/2015 | Yoshimizu ..... | B65H 5/068 271/3.16 |
| 2016/0114999 | A1 | 4/2016 | Suzuki et al. | |
| 2016/0115000 | A1 | 4/2016 | Sugiyama et al. | |
| 2016/0185552 | A1 | 6/2016 | Hoshino et al. | |

FOREIGN PATENT DOCUMENTS

| | | |
|---|---|---|
| JP | 2014-105063 | 6/2014 |
| JP | 2014-227284 | 12/2014 |
| JP | 2014-240325 | 12/2014 |

* cited by examiner

SHEET FOLDING METHOD, IMAGE FORMING SYSTEM, AND SHEET FOLDING DEVICE WITH MOTOR EMPLOYING BEING CONTROLLED TO PERFORM A FEEDBACK CONTROL WITH AN INTEGRAL GAIN

CROSS-REFERENCE TO RELATED APPLICATION

This patent application is based on and claims priority pursuant to 35 U.S.C. § 119(a) to Japanese Patent Application No. 2016-106312, filed on May 27, 2016, in the Japan Patent Office, the entire disclosure of which is hereby incorporated by reference herein.

BACKGROUND

Technical Field

This disclosure relates to a sheet folding device, an image forming system incorporating the sheet folding device, and a sheet folding method using the sheet folding device and the image forming system.

Related Art

As an example of sheet folding methods of performing a sheet folding operation to a sheet conveyed from an image forming apparatus, a leading end abutting method and a sheet holding and reversing method are known.

The leading end abutting method is a sheet folding method through which a sheet is firstly abutted against a stopper to adjust a sheet folding position and to form a warped portion of the sheet, and then the warped portion of the sheet is held in a sheet folding nip region, performed in a dedicated passage that is branched from a sheet conveyance passage through which the sheet is conveyed from an upstream device to a downstream device.

The sheet holding and reversing method is a sheet folding method through which sheet conveying members are rotated in a reverse direction while a sheet is supported between the sheet conveying members, so that a warped portion of the sheet is held in a sheet holding nip region, performed in a sheet conveyance passage through which the sheet is conveyed from an upstream device to a downstream device.

As can be seen from the above, the sheet holding and reversing method can do without including the dedicated passage that is branched from the sheet conveyance passage through which the sheet is conveyed from the upstream device to the downstream device. In addition, in the sheet holding and reversing method, the sheet folding position of the sheet is adjusted not by the stopper but by the rotation of the sheet conveying members disposed on a downstream side in the sheet conveying direction while the sheet conveying members are holding the sheet. Accordingly, a range of movement of the stopper may not be included in the sheet folding device and the image forming apparatus. Consequently, a reduction in size of the sheet folding device can be achieved.

There are some examples of a sheet folding device employing the sheet holding and reversing method that includes the above-described features.

As a first example, a sheet folding device includes a first pair of sheet conveying members that conveys a sheet, a second pair of sheet conveying members that receives the sheet conveyed by the first pair of sheet conveying members and further conveys the sheet, and a third pair of sheet conveying members that folds the sheet by rotating the second pair of sheet conveying members in the reverse direction in a state in which the first pair of sheet conveying members and the second pair of sheet conveying members are holding the sheet therebetween. In this configuration, one roller of the second pair of sheet conveying members also functions as one of the third pair of sheet conveying members.

As a second example, in the sheet folding device having the above-described configuration, the first pair of sheet conveying members and the second pair of sheet conveying members are driven by a single drive motor.

As a third example, a sheet folding device includes a first pair of sheet conveying members that folds a sheet, a second pair of sheet conveying members that receives the sheet folded by the first pair of sheet conveying members and further conveys the sheet, and a third pair of sheet conveying members that further folds the folded sheet. The second pair of sheet conveying members is rotatable in both directions, which are a forward direction and a reverse direction, while being driven for sheet conveyance. When the second pair of sheet conveying members is not driven for sheet conveyance, one direction of rotation of the second pair of sheet conveying members is locked while the other direction of rotation of the second pair of sheet conveying members is rotatable.

The first example employs the sheet holding and reversing method, that is, one roller of the second pair of sheet conveying members also functions as one of the third pair of sheet conveying members. According to this configuration, this sheet folding device achieves a reduction in size. When the second pair of sheet conveying members are rotated in the reverse direction while holding the sheet therebetween, a motor load significantly changes depending on paper size and thickness, and therefore the amounts of conveyance vary due to driving of the motor, and therefore it is likely that the sheet folding position is shifted.

By contrast, the respective sheet folding devices of the second and third examples employ a feedback control to control the driving of the motor, so that the sheet can be folded at a correct position.

The feedback control is performed to correct the variation in amounts of conveyance of a drive motor but is performed to basically correct a speed of conveyance when the speed is shifted. By correcting the speed of conveyance of the sheet, the variation in amounts of conveyance can be corrected. However, the positional shift causing the variation in amounts of conveyance is not directly corrected while the speed of conveyance of the sheet is controlled.

SUMMARY

At least one aspect of this disclosure provides a sheet folding device including a first drive motor, a first sheet conveyor driven by the first drive motor and configured to receive a sheet and to convey a sheet toward a downstream side of a sheet conveying direction, a second sheet conveyor driven by the second drive motor and configured to receive the sheet conveyed from the first sheet conveyor and to convey the sheet further to the downstream side of the sheet conveying direction, and a controller configured to fold the sheet to a predetermined folding length set according to an amount of conveyance of the sheet by the second sheet conveyor while the sheet is being held between the first sheet conveyor and the second sheet conveyor, and to perform a feedback control with an integral gain to the second drive motor.

Further, at least one aspect of this disclosure provides an image forming system including an image forming apparatus configured to form an image on the sheet, and the above-described sheet folding device configured to fold the sheet having the image formed by the image forming apparatus.

Further, at least one aspect of this disclosure provides a sheet folding method including receiving a sheet by a first sheet conveyor driven by a first motor, conveying the sheet by the first sheet conveyor toward a downstream side of a sheet conveying direction, receiving the sheet conveyed from the first sheet conveyor by a second sheet conveyor driven by a second motor, conveying the sheet by the second sheet conveyor toward the downstream side of the sheet conveying direction, performing a feedback control with an integral gain to the second motor, setting a folding length of the sheet according to an amount of conveyance of the sheet conveyed by the second sheet conveyor while holding the sheet by the first sheet conveyor and the second sheet conveyor, and folding the sheet to the set folding length of the sheet.

DETAILED DESCRIPTION

Figure 1:
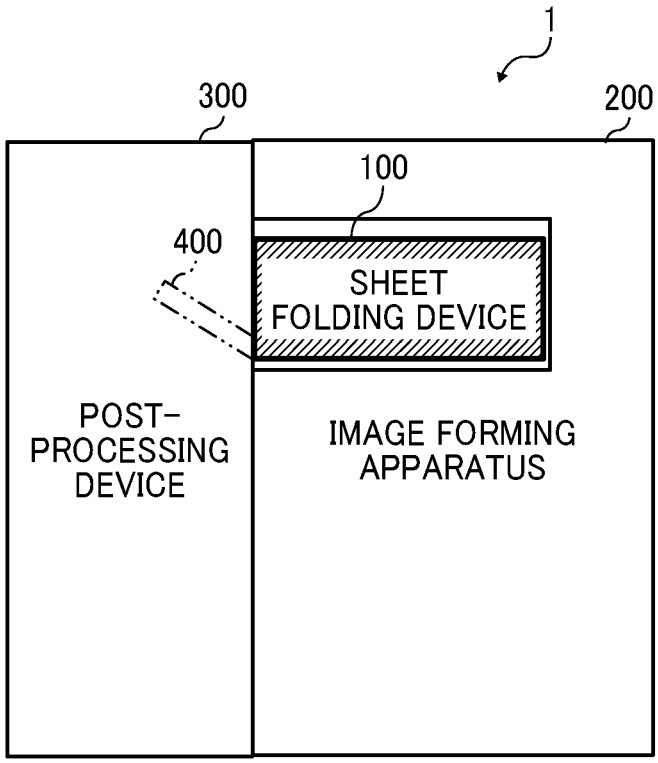
FIG. 1 is a diagram illustrating a schematic configuration of an image forming system according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet folding device, an image forming system incorporating the sheet folding device, and a sheet folding method using the sheet folding device and the image forming system, with reference to the following figures.

FIG. 1 is a diagram illustrating a schematic configuration of an image forming system 1 according to an embodiment of this disclosure.

It is to be noted that identical parts are given identical reference numerals and redundant descriptions are summarized or omitted accordingly.

The image forming system 1 includes an image forming apparatus 200 may be a copier, a facsimile machine, a printer, a multifunction peripheral or a multifunction printer (MFP) having at least one of copying, printing, scanning, facsimile, and plotter functions, or the like. According to the present example, the image forming apparatus 200 included in the image forming system 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium, and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, an image forming system 1 basically includes an image forming apparatus 200, a sheet folding device 100, and a post-processing device 300. The sheet folding device 100 is an in-body sheet ejection device that is provided to a sheet discharging part of the image forming apparatus 200. After the image forming apparatus 200 has performed image formation to form an image on a sheet, the sheet is conveyed to the sheet folding device 100. The sheet folding device 100 performs a predetermined sheet folding operation to the sheet, and then the sheet is further conveyed to the post-processing device 300. The post-processing device 300 performs post processes, for example, alignment process, binding process, and bookbinding process, to a folded sheet or a non-folded sheet. It is to be noted that the sheet folding device 100 may be disposed between the image forming apparatus 200 and the post-processing device 300 to align the image forming apparatus 200, the sheet folding device 100, and the post-processing device 300 as an in-line arrangement.

Figure 2:
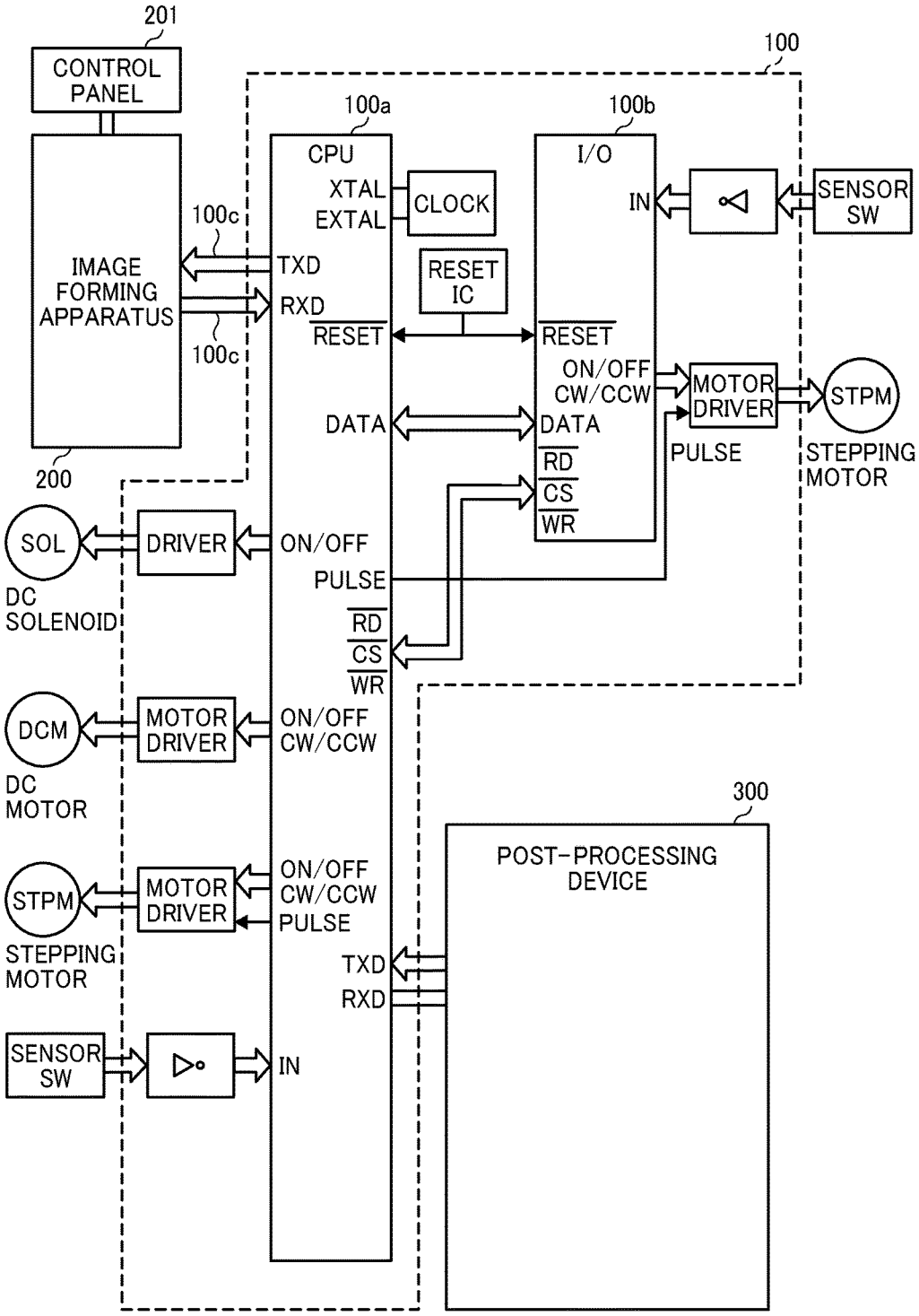
FIG. 2 is a block diagram illustrating a configuration of a controller of the image forming system of FIG. 1.

FIG. 2 is a block diagram illustrating a configuration of a controller included in the image forming system 1 according to the present embodiment of this disclosure.

As illustrated in FIG. 2, the sheet folding device 100 includes a control circuit including a microcomputer having a CPU 100*a* and an input and output (I/O) interface 100*b*. The CPU 100*a* receives signals from a CPU of the image forming apparatus 200 or from each switch on a control panel 201, and from each sheet detection sensor, which are inputted via a communication interface 100*c*. The CPU 100*a* performs a predetermined control based on a signal inputted from the image forming apparatus 200. Further, the CPU 100*a* controls solenoids and motors via drivers and motor drivers and obtains information of the sheet detection sensors provided in the sheet folding device 100 via the communication interface 100*c*. Further, a motor driver drives a motor via the I/O interface 100*b* with respect to a target to be controlled, for example.

It is to be noted that the CPU 100*a* performs the control in a RAM, for example, by reading a program code stored in a ROM and using to the RAM based on a program defined by the program codes.

Figure 3:
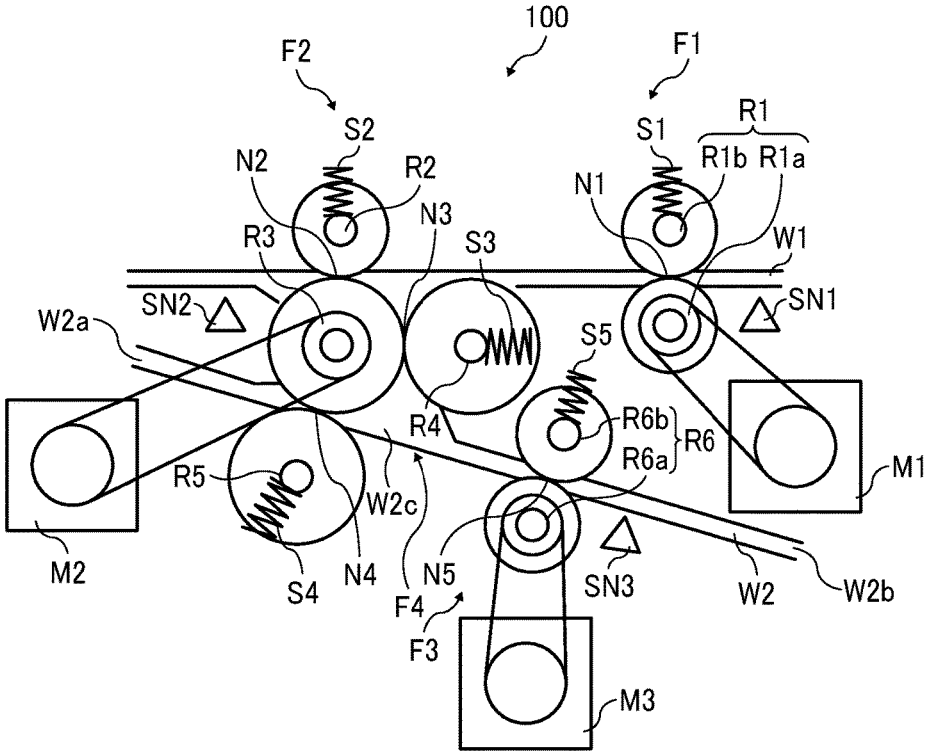
FIG. 3 is a schematic diagram illustrating an example of a sheet folding mechanism employed in a sheet folding device of FIG. 1.

FIG. 3 is a schematic diagram illustrating the sheet folding mechanism employed in the sheet folding device 100 according to an embodiment of this disclosure.

The sheet folding device 100 includes two sheet conveyance passages, which are a first sheet conveyance passage W1 and a second sheet conveyance passage W2, and multiple sheet conveying units, which are a first sheet conveying unit F1, a second sheet conveying unit F2, and a third sheet conveying unit F3. The first sheet conveying unit F1, the second sheet conveying unit F2, and the third sheet conveying unit F3 are disposed along the first sheet conveyance passage W1 and the second sheet conveyance passage W2.

The second sheet conveying unit F2 is disposed holding (across) the first sheet conveyance passage W1 and the second sheet conveyance passage W2, so as to fold and transfer a sheet P from the first sheet conveyance passage W1 to the second sheet conveyance passage W2.

The first sheet conveying unit F1 includes a first pair of sheet conveying rollers R1. The second sheet conveying unit F2 includes a first sheet conveying roller R2, a second sheet conveying roller R3, a third sheet conveying roller R4, and a fourth sheet conveying roller R5. The third sheet conveying unit F3 includes a second pair of sheet conveying rollers R6. The first pair of sheet conveying rollers R1 (the first sheet conveying unit F1) is driven by a drive motor M1, so as to apply a conveying force to the sheet P. The second pair of sheet conveying rollers R6 (the third sheet conveying unit F3) is driven by a drive motor M3, so as to apply a conveying force to the sheet P. The third sheet conveying unit F3 sets a direction of conveyance of the sheet P that has been folded to either in a forward direction or a reverse direction.

The sheet conveying roller R2, the second sheet conveying roller R3, the third sheet conveying roller R4, and the fourth sheet conveying roller R5 are driven by a drive motor M2.

In the first sheet conveying unit F1, two rollers of the first pair of sheet conveying rollers R1 are disposed facing each other across the first sheet conveyance passage W1. Consequently, a first nip region N1 is formed between the two rollers of the first pair of sheet conveying rollers R1.

The first pair of sheet conveying rollers R1 is disposed on an entrance side of the first sheet conveyance passage W1 of the sheet folding device 100, where the first pair of sheet conveying rollers R1 receives the sheet P fed from the image forming apparatus 200. The first pair of sheet conveying rollers R1 is driven by the first drive motor M1 to covey the sheet P toward a downstream side in the sheet folding device 100.

Figure 4:
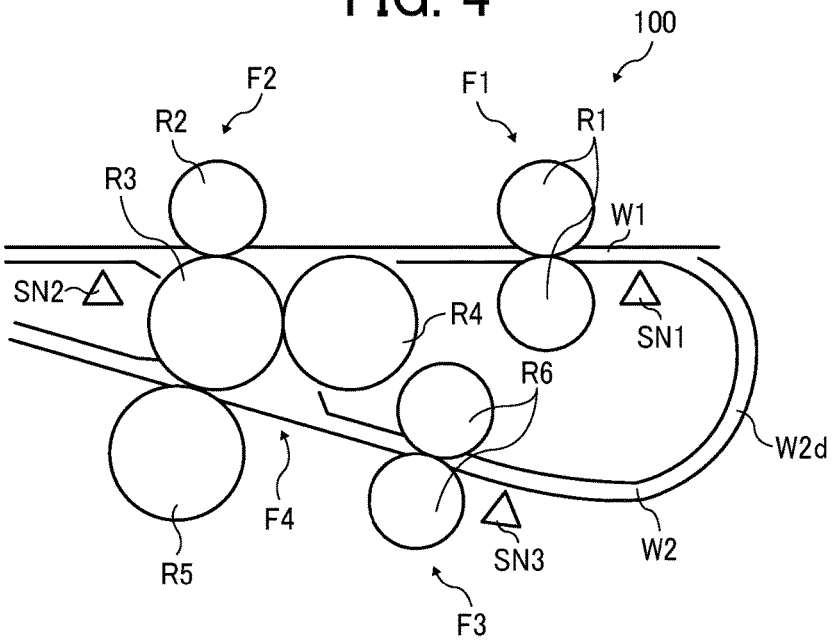
FIG. 4 is a diagram illustrating an initial state of a half fold operation performed in the sheet folding mechanism of FIG. 3, before a sheet is conveyed from an image forming apparatus.

The second sheet conveyance passage W2 has an end portion W2*a* and an end portion W2*b*. The end portion W2*a* is located on a downstream side (that is, a sheet ejection side) in the sheet conveying direction and meets the first sheet conveyance passage W1 at a downstream side of the first sheet conveyance passage W1, as illustrated in FIG. 4. The end portion W2*b* is located on an upstream side in the sheet conveying direction and meets the first sheet conveyance passage W1 at an upstream side of the first sheet conveyance passage W1, as illustrated in FIG. 4. The second sheet conveying unit F2 is disposed downstream from the first pair of sheet conveying rollers R1 in the first sheet conveyance passage W1 in the sheet conveying direction. A communication passage W2*c* is disposed where the second sheet conveying unit F2 is located. The communication passage W2*c* connects the first sheet conveyance passage W1 and the second sheet conveyance passage W2 to communicate with each other.

In the second sheet conveying unit F2, the first sheet conveying roller R2 and the second sheet conveying roller R3 are disposed facing each other across first sheet conveyance passage W1. Consequently, a second nip region N2 is formed between the first sheet conveying roller R2 and the second sheet conveying roller R3.

Further, the second sheet conveying roller R3 and the third sheet conveying roller R4 are disposed facing each other between the first sheet conveyance passage W1 and second sheet conveyance passage W2. Consequently, a third nip region N3 is formed between the second sheet conveying roller R3 and the third sheet conveying roller R4. A passage that is guided by the third nip region N3 corresponds to the communication passage W2*c* that guides the sheet P from the first sheet conveyance passage W1 to the second sheet conveyance passage W2.

Further, the second sheet conveying roller R3 and the fourth sheet conveying roller R5 are disposed facing each other across second sheet conveyance passage W2. Consequently, a fourth nip region N4 is formed between the second sheet conveying roller R3 and the fourth sheet conveying roller R5.

As previously described, the first sheet conveying roller R2, the second sheet conveying roller R3, the third sheet conveying roller R4, and the fourth sheet conveying roller R5 are driven by the second drive motor M2 that drives the second sheet conveying roller R3. Specifically, the second sheet conveying unit F2 is driven to rotate by the second drive motor M2. The second drive motor M2 is rotatable in both directions, which are the forward direction and the reverse direction. By changing the direction of rotation, the second drive motor M2 conveys the sheet P and performs a sheet folding operation.

It is to be noted that the second sheet conveying unit F2 according to the present embodiment includes pairs of sheet conveying rollers but the configuration is not limited thereto. For example, a pair of or pairs of adhesive sheet conveying rollers may be applied to the second sheet conveying unit F2.

In the second sheet conveying unit F2, the second sheet conveying roller R3 functions as a sheet conveying drive roller. Similarly, the first sheet conveying roller R2, the third sheet conveying roller R4, and the fourth sheet conveying roller R5 functions as a sheet conveying driven roller to be rotated with the second sheet conveying roller R3 while contacting the second sheet conveying roller R3. Further, the second sheet conveying roller R3 and the third sheet conveying roller R4 form a first sheet folding unit, and the second sheet conveying roller R3 and the fourth sheet conveying roller R5 form a second sheet folding unit.

The first sheet conveying roller R2 is biased by a first compression spring S2 that functions as a biasing body so as to apply an elastic force toward the second sheet conveying roller R3. The third sheet conveying roller R4 is biased by a second compression spring S3 that functions as a biasing body so as to apply an elastic force toward the second sheet conveying roller R3. The fourth sheet conveying roller R5 is biased by a third compression spring S4 that functions as a biasing body so as to apply an elastic force toward the second sheet conveying roller R3. According to this configuration, the first sheet conveying roller R2, the third sheet conveying roller R4, and the fourth sheet conveying roller R5 remain in contact with the second sheet conveying roller R3. Accordingly, the first sheet conveying roller R2, the third sheet conveying roller R4, and the fourth sheet conveying roller R5 are rotated with the second sheet conveying roller R3 by receiving respective driving forces form the second sheet conveying roller R3.

The first pair of sheet conveying rollers R1 includes a sheet conveying drive roller R1*a* and a sheet conveying driven roller R1*b*. The first drive motor M1 applies a driving force to the sheet conveying drive roller R1*a*. The sheet conveying driven roller R1*b* receives the elastic force applied by the first compression spring S1 to move toward the sheet conveying drive roller R1*a*. Consequently, the sheet conveying driven roller R1*b* contacts the sheet conveying drive roller R1*a* in the first nip region N1. Accordingly, the sheet conveying driven roller R1*b* is rotated with the sheet conveying drive roller R1*a* while contacting the sheet conveying drive roller R1*a*.

The second pair of sheet conveying rollers R6 includes a sheet conveying drive roller R6*a* and a sheet conveying driven roller R6*b*. The third drive motor M3 applies a driving force to the sheet conveying drive roller R6*a*. The sheet conveying driven roller R6*b* receives the elastic force applied by the fifth compression spring S5 to move toward the sheet conveying drive roller R6*a*. Consequently, the sheet conveying driven roller R6*b* contacts the sheet conveying drive roller R6*a* in a fifth nip region N5 formed between the sheet conveying drive roller R6*a* and the sheet conveying driven roller R6*b*. Accordingly, the sheet conveying driven roller R6*b* is rotated with the sheet conveying drive roller R6*a* while contacting the sheet conveying drive roller R6*a*.

Further, a first sheet detection sensor SN1 is disposed at a position immediately before the first pair of sheet conveying rollers R1 in first sheet conveyance passage W1. Similarly, a second sheet detection sensor SN2 is disposed at a position immediately after the second nip region N2 formed by the first sheet conveying roller R2 and the second sheet conveying roller R3. Further, a third sheet detection sensor SN3 is disposed at a position nearest the second pair of sheet conveying rollers R6 and separated from the fourth sheet conveying roller R5 in the second sheet conveyance passage W2. It is to be noted that the first sheet detection sensor SN1 functions as an inlet sheet detection sensor and the second sheet detection sensor SN2 functions as an outlet sheet detection sensor.

The sheet folding device 100 includes the sheet folding mechanism illustrated in FIG. 3 to perform a half fold, a Z-fold, a letter fold-in, and a letter fold-out. Each sheet folding operation described above is instructed by the CPU 100*a* illustrated in FIG. 3 and is performed by the sheet folding mechanism of the sheet folding device 100.

Embodiment 1.

A description is given of a sheet folding operation when the half fold is performed by a configuration according to Embodiment 1, with reference to FIGS. 4 through 11.

Figure 5:
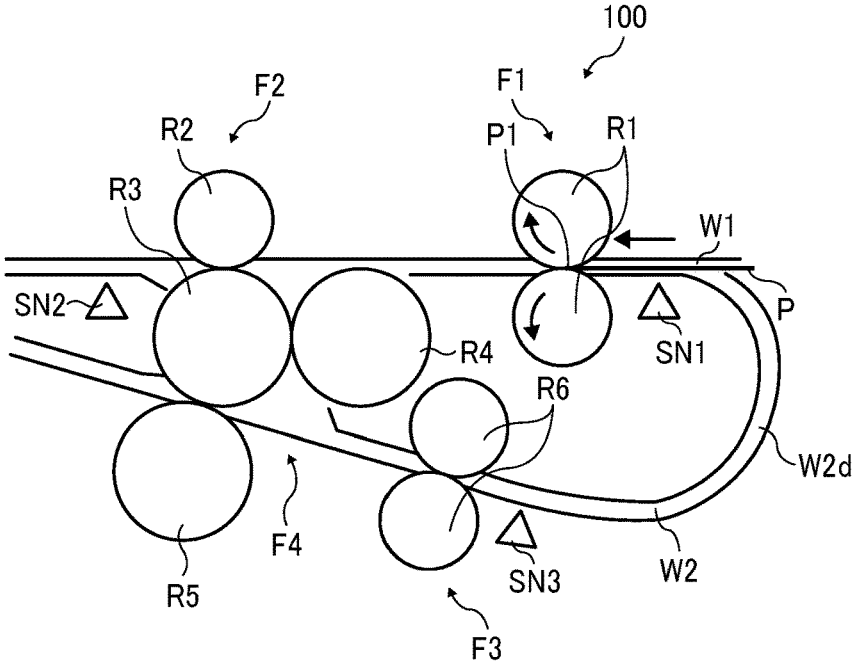
FIG. 5 is a diagram illustrating a state in which the sheet is conveyed from the image forming apparatus to a first sheet conveyance passage.
Figure 6:
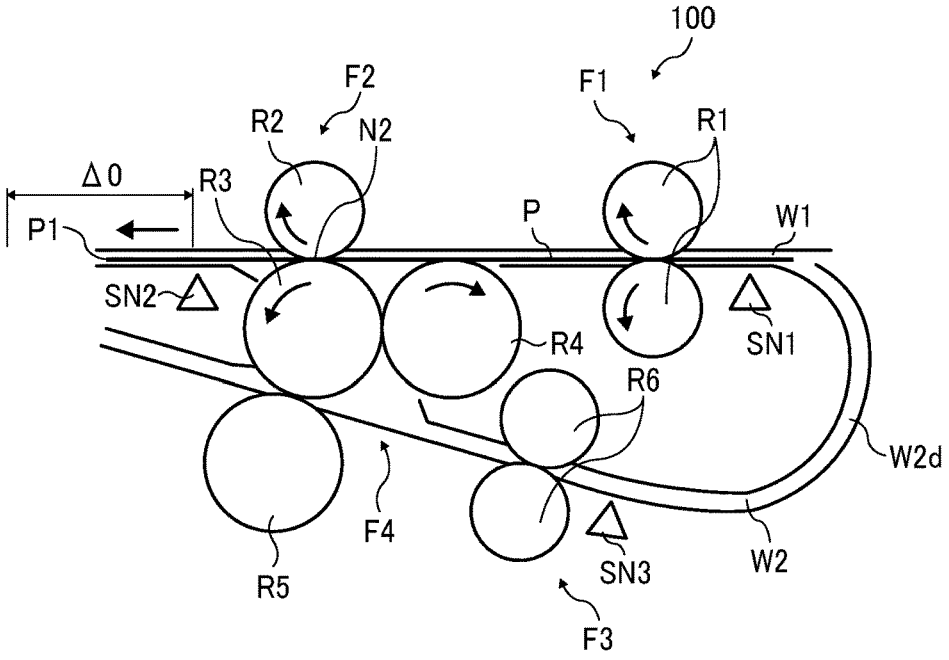
FIG. 6 is a diagram illustrating a state in which the sheet is conveyed to a sheet folding position by a first sheet conveying unit and a second sheet conveying unit.
Figure 7:
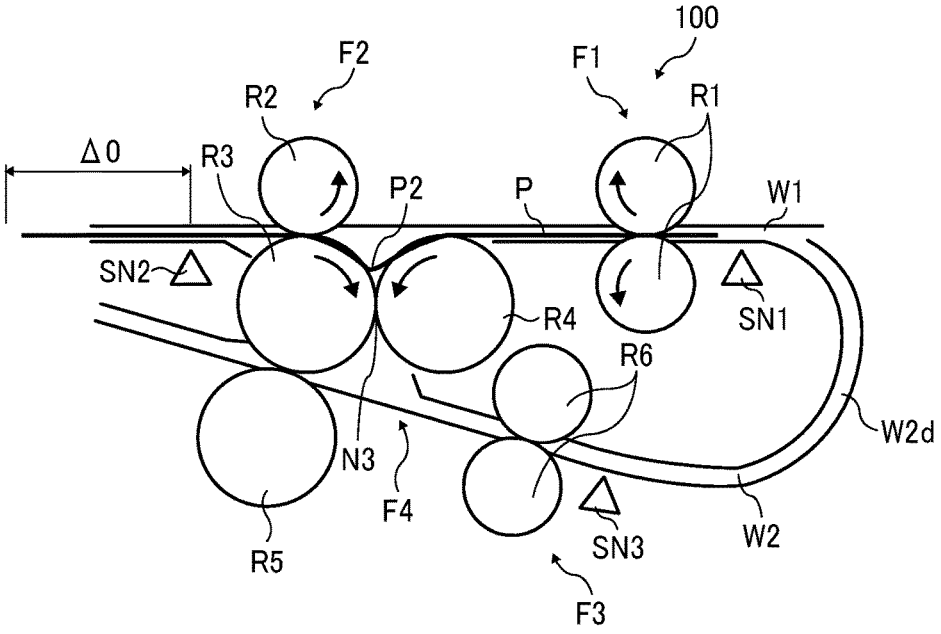
FIG. 7 is a diagram illustrating a state in which the second sheet conveying unit rotates in a reverse direction and the sheet is folded in two by the second sheet conveying unit at a half fold position.
Figure 8:
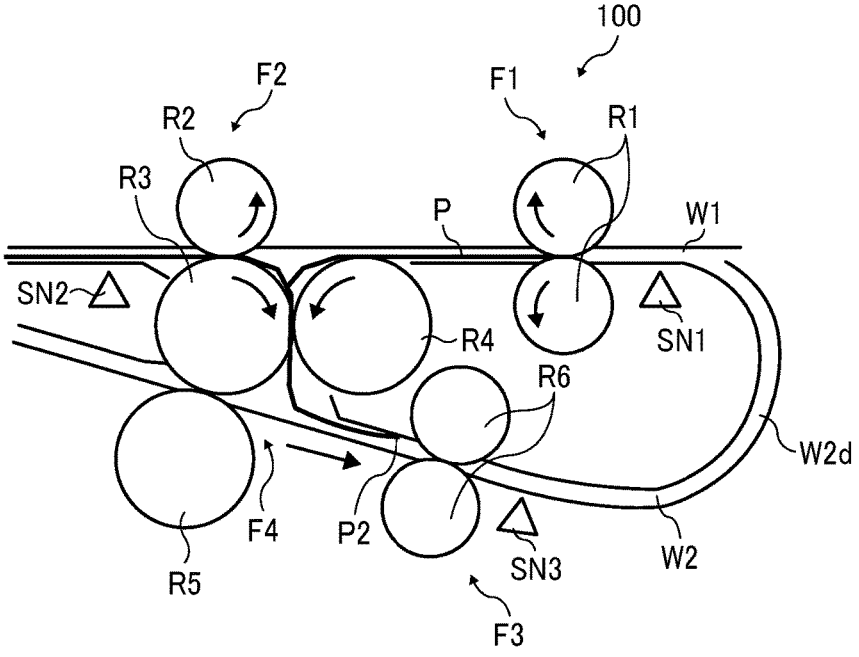
FIG. 8 is a diagram illustrating a state in which the sheet that is folded in two by the second sheet conveying unit is conveyed from the second sheet conveying unit to a third sheet conveying unit.
Figure 9:
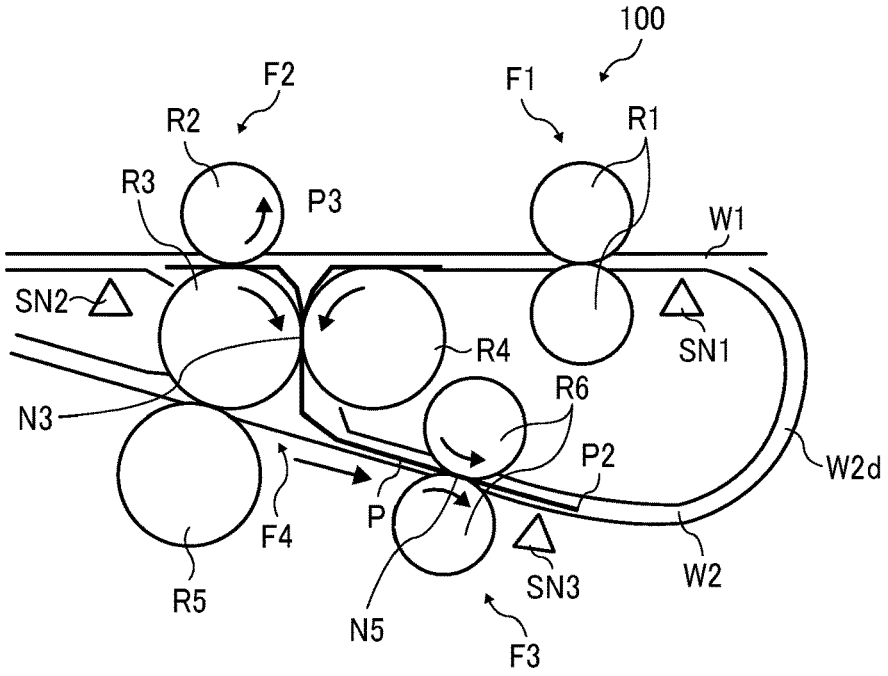
FIG. 9 is a diagram illustrating a state in which a fold of the sheet is reinforced by a third sheet conveying unit and the sheet is further conveyed to the second sheet conveyance passage.
Figure 10:
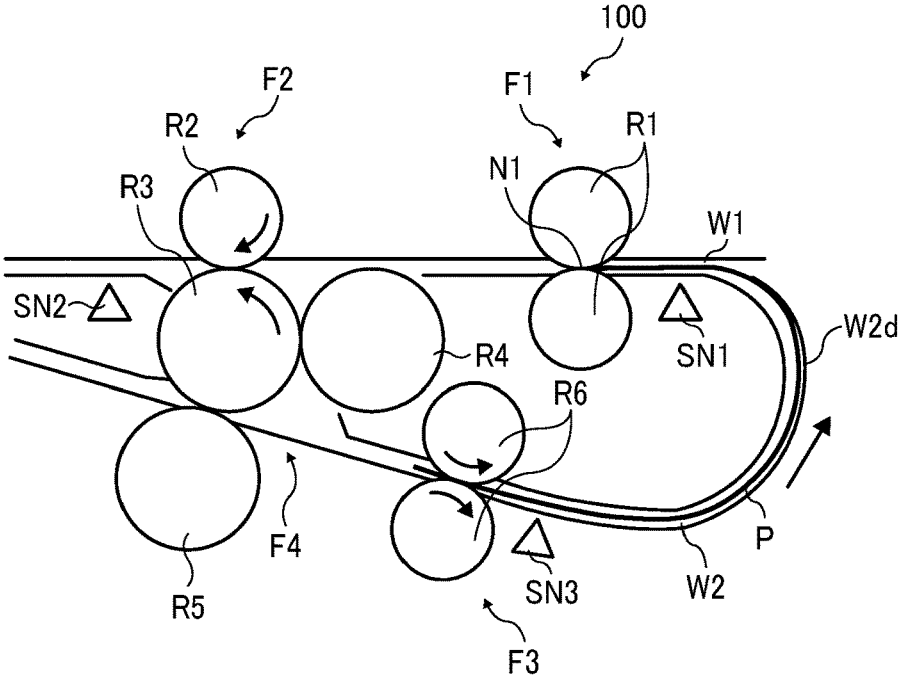
FIG. 10 is a diagram illustrating a state in which the sheet is conveyed from the sheet conveyance passage to a first sheet conveyance passage.
Figure 11:
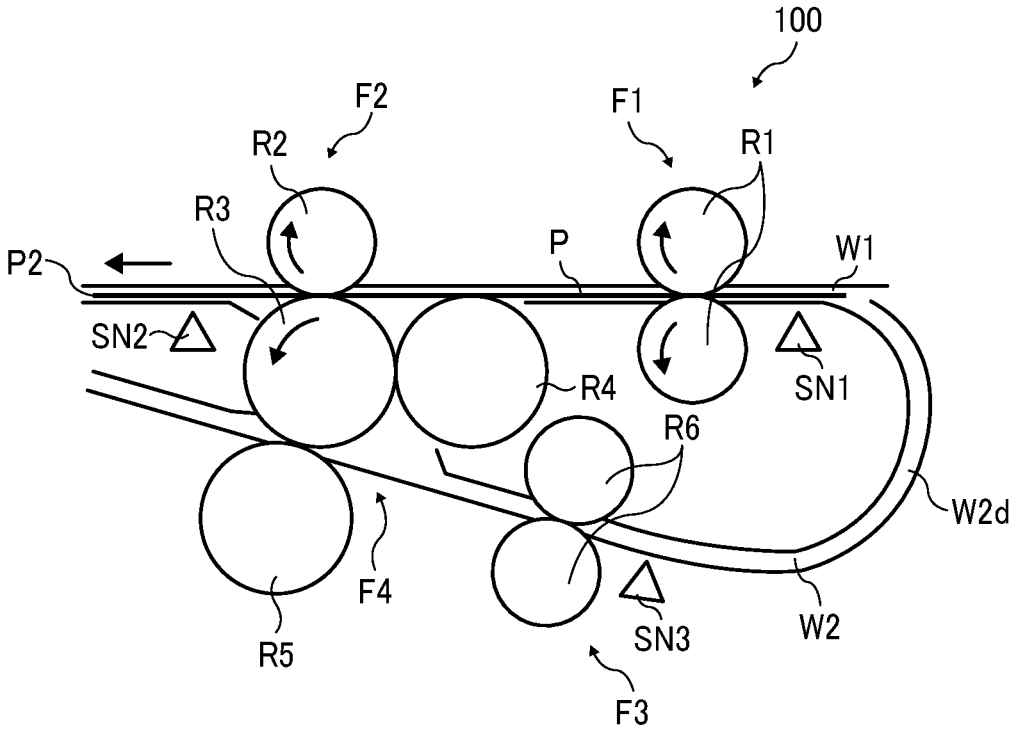
FIG. 11 is a diagram illustrating a state in which the two-folded sheet that has been returned to a first sheet conveyance passage is ejected.

FIG. 4 is a diagram illustrating an initial state of the half fold operation performed in the sheet folding mechanism of FIG. 3, before the sheet P is conveyed from the image forming apparatus 200. FIG. 5 is a diagram illustrating a state in which the sheet P is conveyed from the image forming apparatus 200 to the first sheet conveyance passage W1. FIG. 6 is a diagram illustrating a state in which the sheet P is conveyed to a sheet folding position by the first sheet conveying unit F1 and the second sheet conveying unit F2. FIG. 7 is a diagram illustrating a state in which the second sheet conveying unit F2 rotates in the reverse direction and the sheet P is folded in two by the second sheet conveying unit F2 at a half fold position. FIG. 8 is a diagram illustrating a state in which the sheet P that is folded in two by the second sheet conveying unit F2 is conveyed from the second sheet conveying unit F2 to the third sheet conveying unit F3. FIG. 9 is a diagram illustrating a state in which a fold of the sheet P is reinforced by the third sheet conveying unit F3 and the sheet P is further conveyed to the second sheet conveyance passage W2. FIG. 10 is a diagram illustrating a state in which the sheet P is conveyed from the sheet conveyance passage W2 to the first sheet conveyance passage W1. FIG. 11 is a diagram illustrating a state in which the half folded sheet P that has been returned to the first sheet conveyance passage W1 is ejected.

After the initial state of FIG. 4 in which the sheet P has not been conveyed from the image forming apparatus 200, the sheet P enters the first sheet conveyance passage W1 from the image forming apparatus 200, as illustrated in FIG. 5. Upon detection of the leading end P1 of the sheet P by the first sheet detection sensor SN1, which functions as the inlet sheet detection sensor, the first drive motor M1 starts rotating. After having entered to the first nip region N1 of the first pair of sheet conveying rollers R1, the sheet P is conveyed by the first pair of sheet conveying rollers R1 toward the second sheet conveying unit F2 disposed downstream from the first pair of sheet conveying rollers R1 in the sheet conveying direction. On arrival of the leading end P1 of the sheet P to the second sheet conveying unit F2, the sheet P is held in the second nip region N2 between the first sheet conveying roller R2 and the second sheet conveying roller R3 to be conveyed toward a further downstream side in the sheet conveying direction.

Upon detection of the leading end P1 of the sheet P, the second drive motor M2 decreases the speed of conveyance of the sheet P. Accordingly, the sheet P is conveyed to a predetermined position by an amount of conveyance Δ0 from the second sheet detection sensor SN2, so as to perform the half fold operation, as illustrated in FIG. 6. When the sheet P reaches the predetermined position downstream from the second sheet detection sensor SN2 by the amount of conveyance Δ0, in other words, when the sheet P reaches the predetermined position where the center of the sheet P in the sheet conveying direction is folded in two with the aid of the third nip region N3, the conveyance of the sheet P is temporarily stopped. Then, the first sheet conveying roller R2 and the second sheet conveying roller R3 start rotating in the reverse direction, as illustrated in FIG. 7. At this time, the first pair of sheet conveying rollers R1 stops in synchronization with the rotations of the first sheet conveying roller R2 and the second sheet conveying roller R3. Then, first pair of sheet conveying rollers R1 rotates at the same speed as the first sheet conveying roller R2 and the second sheet conveying roller R3 to convey the sheet P toward the downstream side in the sheet conveying direction.

In this case, it is not controlled that the second drive motor M2 stops instantly when the sheet P that is conveyed from the upstream side is passing a sheet detection position at which the second sheet detection sensor SN2 detects the leading end P1 of the sheet P but it is controlled that the second drive motor M2 stops after the sheet P has passed the predetermined stop position located downstream from the second sheet detection sensor SN2 by the amount of conveyance Δ0 or rotates in the reverse direction after the sheet P has passed the sheet detection position of the second sheet detection sensor SN2.

The amount of conveyance Δ0 to be set is a calculation result that is automatically calculated by the CPU 100*a* based on data of the length of the sheet P in the sheet conveying direction that is transmitted from the image forming apparatus 200 to the CPU 100*a* before the start of the job (i.e., before the start of image formation onto the sheet P).

Alternatively, the amount of conveyance Δ0 can be set based on a table including relations of sheet sizes and amounts of movement of the sheet P. The table is previously prepared and stored in the ROM, so that the amount of movement of the sheet P can be set according to the sheet size by reference to the table in the ROM.

As second drive motor M2 starts rotating in the reverse direction, the sheet P bends toward the third nip region N3 formed between the second sheet conveying roller R3 and the third sheet conveying roller R4 in the communication passage W2*c*, as illustrated in FIG. 7. Consequently, as illustrated in FIG. 8, the sheet P is guided and folded by the third nip region N3. Then, the folded sheet P having a fold P2 at the leading end of the sheet P is conveyed toward the second sheet conveyance passage W2.

It is to be noted that the above-described sheet folding operation can be performed without stopping the first pair of sheet conveying rollers R1 while the first pair of sheet conveying rollers R1 continuously rotates in the forward direction toward a sheet outlet side.

In the communication passage W2*c*, the first sheet conveyance passage W1 has one side facing the third nip region N3, and the other side that is opposite the one side. The one side is open and the other side is closed. Therefore, the sheet P bends toward the one side facing the third nip region N3. Alternatively, in order not to generate a paper jam, a guide pawl may be disposed at a position immediately before the second nip region N2 formed between the first sheet conveying roller R2 and the second sheet conveying roller R3. When the first sheet conveying roller R2 and the second sheet conveying roller R3 are rotated in the reverse direction, which is an opposite direction to the sheet conveying direction, a direction of bend of the sheet P can be guided toward the third nip region N3.

Consequently, as illustrated in FIG. 8, the sheet P has the fold P2 that has been folded in the third nip region N3. The fold P2 of the sheet P is guided along a downward slope of the second sheet conveyance passage W2 to the second pair of sheet conveying rollers R6. Then, the fold P2 of the sheet P is reinforced in the fifth nip region N5 of the second pair of sheet conveying rollers R6. Thereafter, the folded sheet P passes through a connecting sheet conveyance passage W2*d* that connects the second sheet conveyance passage W2 and the first sheet conveyance passage W1, so that the sheet P is conveyed from the upstream side of the first pair of sheet conveying rollers R1 of the first sheet conveyance passage W1 to the first nip region N1 of the first pair of sheet conveying rollers R1, as illustrated in FIGS. 9 and 10.

The sheet P conveyed to the first nip region N1 of first pair of sheet conveying rollers R1 is further conveyed by first pair of sheet conveying rollers R1 toward the second sheet conveying unit F2. As illustrated in FIG. 11, the sheet P is conveyed to the first sheet conveying roller R2 and the second sheet conveying roller R3 of the second sheet conveying unit F2, and is then discharged from the sheet folding device 100 by the first sheet conveying roller R2 and the second sheet conveying roller R3.

At this time, when a trailing end of the sheet P that has been folded by the half fold passes the third sheet detection sensor SN3, the second drive motor M2 and the third drive motor M3 are stopped. When a subsequent sheet is to be conveyed, the sheet folding operation performed by the sheet folding device 100 according to Embodiment 1 illustrated in FIGS. 4 through 11 is repeated, and the two-folded subsequent sheet is output to the post-processing device 300.

It is to be noted that, when the image forming system 1 does not include the post-processing device 300, the sheet P may be output to a sheet output tray 400 that is disposed instead of the post-processing device 300. Accordingly, a relatively smaller system configuration of this image forming system 1 includes the image forming apparatus 200 and a sheet folding device 100.

Further, the sheet folding device 100 includes the sheet folding mechanism illustrated in FIG. 3 to perform a half fold operation, a Z-fold operation, a letter fold-in operation, and a letter fold-out operation. In the present embodiment, the half fold operation is performed as an example of the sheet folding operation. Regarding the Z-fold operation, the letter fold-in operation, and the letter fold-out operation, known techniques are employed, and therefore the descriptions of the known techniques are omitted here.

Embodiment 2

Figure 12A:
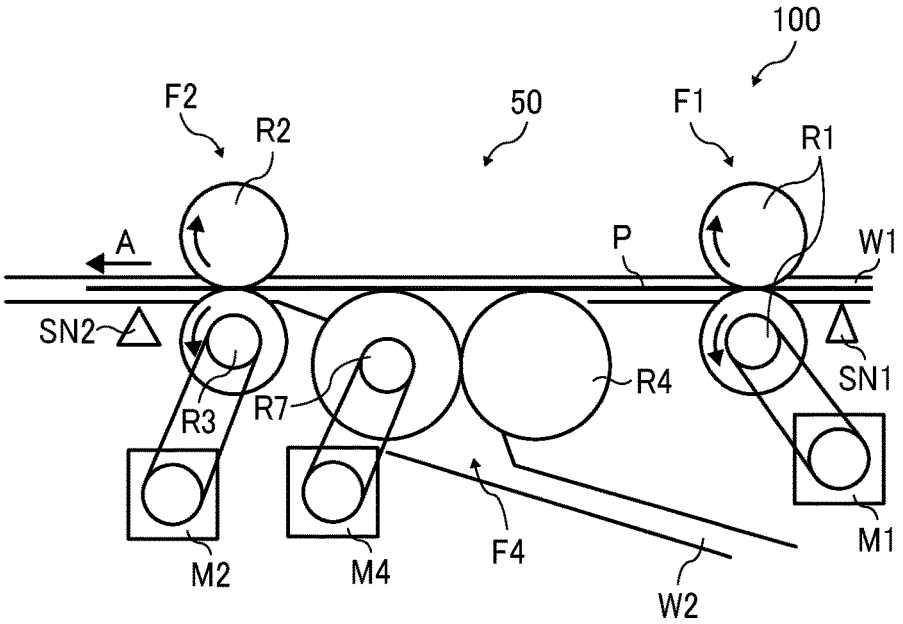
FIGS. 12A and 12B are diagrams illustrating a main part of a sheet folding mechanism according to Embodiment 2 of this disclosure, included in a sheet folding device according to Embodiment 2 of this disclosure, and a sheet folding operation performed by the sheet folding mechanism.
Figure 12B:
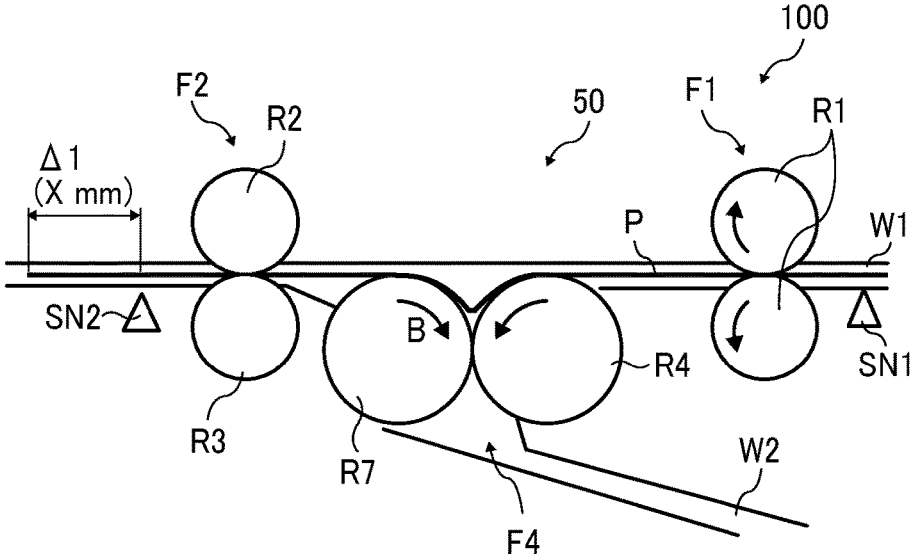

Now, a description is given of a sheet folding mechanism 50 according to Embodiment 2 of this disclosure, included in the sheet folding device 100 according to Embodiment 2 of this disclosure, with reference to FIGS. 12A and 12B.

FIGS. 12A and 12B are diagrams illustrating a main part of the sheet folding mechanism 50 according to Embodiment 2 of this disclosure, included in the sheet folding device 100 according to Embodiment 2 of this disclosure, and the sheet folding operation performed by the sheet folding mechanism 50. Specifically, FIG. 12A is a diagram illustrating a state in which the sheet P is conveyed toward the downstream side of the first sheet conveyance passage W1. FIG. 12B is a diagram illustrating a state immediately after the start of the sheet folding operation.

In Embodiment 2, the sheet folding mechanism performs the sheet folding operation by a sheet folding control including a feedback control with an integral gain.

It is to be noted that the elements or components of the sheet folding device 100 according to FIGS. 12A and 12B denoted by the same reference numerals as those of the sheet folding device 100 that performs the sheet folding operation performed by Embodiment 1 illustrated in FIGS. 4 through 11 and the descriptions thereof are omitted.

Further, in order to avoid complexity, the reference numerals used for the elements or components of the sheet folding device 100 according to Embodiment 1 illustrated in FIGS. 4 through 11 may be used in the descriptions but omitted in the drawings.

In FIGS. 12A and 12B, the sheet folding device 100 includes the sheet folding mechanism 50 according to Embodiment 2 of this disclosure.

The sheet folding mechanism 50 includes the first sheet conveyance passage W1 and the second sheet conveyance passage W2, and the first sheet conveying unit F1 that functions as a first sheet conveyor, the second sheet conveying unit F2 that functions as a second sheet conveyor, and the fourth sheet conveying unit F4 that functions as a third sheet conveyor. The first sheet conveying unit F1, the second sheet conveying unit F2, and the fourth sheet conveying unit F4 are disposed along the first sheet conveyance passage W1 and the second sheet conveyance passage W2.

The first sheet conveying unit F1 is disposed on the entrance side of the first sheet conveyance passage W1 of the sheet folding device 100. The second sheet conveying unit F2 is disposed on the exit side of the first sheet conveyance passage W1. The fourth sheet conveying unit F4 is disposed between or in the middle of the first sheet conveying unit F1 and the second sheet conveying unit F2 along the first sheet conveyance passage W1. That is, the fourth sheet conveying unit F4 is disposed between the first sheet conveyance passage W1 and the second sheet conveyance passage W2, which is the same structure as the second sheet conveying roller R3 and the third sheet conveying roller R4 aligned to each other according to FIGS. 4 through 11. The fourth sheet conveying unit F4 is disposed holding across the first sheet conveyance passage W1 and the second sheet conveyance passage W2, so as to fold and transfer the sheet P from the first sheet conveyance passage W1 to the second sheet conveyance passage W2.

It is to be noted that, in Embodiment 2, the fourth sheet conveying unit F4 is disposed as a single unit and at a position separated from the second sheet conveying unit F2.

Similar to the configuration illustrated in FIGS. 4 through 11, the first sheet conveying unit F1 includes the first pair of sheet conveying rollers R1. The second sheet conveying unit F2 includes the first sheet conveying roller R2 and the second sheet conveying roller R3, both of which form and function as a second pair of sheet conveying rollers. The fourth sheet conveying unit F4 includes the third sheet conveying roller R4 and a fifth sheet conveying roller R7, both of which form and function as a pair of sheet folding rollers.

The first pair of sheet conveying rollers R1 is driven by the drive motor M1 and the second pair of sheet conveying rollers is driven by the second drive motor M2. The fourth sheet conveying unit F4 that functions as a fourth sheet conveyor including a pair of sheet folding rollers is driven by a fourth drive motor M4. For example, a driving force is transmitted to the fifth sheet conveying roller R7 via a timing belt, so that the pair of sheet folding rollers is driven to rotate. Both the first drive motor M1, the second drive motor M2, and the fourth drive motor M4 apply a conveying force to the sheet P. In addition, fourth drive motor M4 applies a folding force to fold the sheet P.

A difference between the configuration illustrated in FIGS. 4 through 11 and the configuration in Embodiment 2 is whether rollers used to a sheet folding operation are driven by one drive motor or two drive motors. Specifically, in the configuration illustrated in FIGS. 4 through 11, the first sheet conveying roller R2, the second sheet conveying roller R3, and the third sheet conveying roller R4 are driven by the second drive motor M2. By contrast, in the configuration in Embodiment 2, the first sheet conveying roller R2 and the second sheet conveying roller R3 are driven by the second drive motor M2 and the third sheet conveying roller R4 and fifth sheet conveying roller R7 are driven by the fourth drive motor M4. The other elements and components in the configuration of Embodiment 2 same as those in the configuration illustrated in FIGS. 4 through 11 are omitted.

Figure 13:
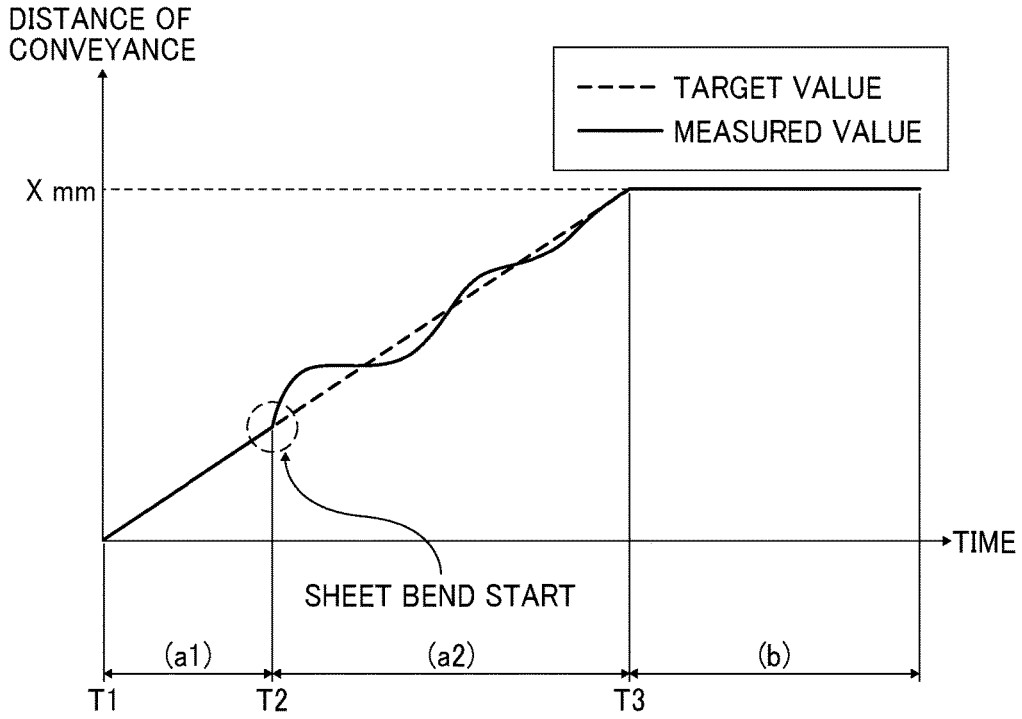
FIG. 13 is a diagram illustrating a relation of a time and a distance of conveyance of the sheet when performing the sheet folding operation according to Embodiment 2 of this disclosure.

Now, a description is given of the sheet folding operation according to Embodiment 2, with further reference to FIG. 13.

FIG. 13 is a diagram illustrating a relation of a time and a distance of conveyance of the sheet P when performing the sheet folding operation according to Embodiment 2 of this disclosure.

As illustrated in FIG. 12A, the sheet folding mechanism 50 conveys the sheet P fed from the image forming apparatus 200, by the first sheet conveying unit F1 and the second sheet conveying unit F2 toward the downstream side in a direction indicated by arrow A in FIG. 12A. The leading end of the sheet P is detected at the second sheet detection sensor SN2 at a timing T1. Then, when the sheet P is conveyed by a predetermined amount of conveyance Δ1 (for example, a distance of X mm) at a timing T2, the second sheet conveying unit F2 stops at a timing T3, and the fourth sheet conveying unit F4 starts rotating in a direction indicated by arrow B in FIG. 12B. As the second sheet conveying unit F2 stops, a linear velocity difference is generated between the first sheet conveying unit F1 and the second sheet conveying unit F2, and therefore the sheet P bends, as illustrated in FIGS. 7 and 12B. That is, in a state in which the leading end of the sheet P is stopped, the first sheet conveying unit F1 conveys the sheet P further to the direction A. As a result, the sheet P bends or warps.

The bend or warp of the sheet P is formed in a space immediately before a nip region formed between the third sheet conveying roller R4 and the fifth sheet conveying roller R7 of the fourth sheet conveying unit F4 (the pair of pair of sheet folding rollers), as illustrated in FIG. 12B. The sheet P enters the nip region at a timing when the largest warp is formed, so as to be conveyed to the second sheet conveyance passage W2 while being folded in two. At this time, the second drive motor M2 that drives the second sheet conveying unit F2 remains stopped. Therefore, even though the sheet P is held by the second nip region N2 of the second sheet conveying unit F2, the sheet P can move in the reverse direction (that is, a direction opposite the direction A) due to the conveying force applied by the fourth sheet conveying unit F4. In order to perform this operation reliably, the configuration of Embodiment 2 may further include a one way clutch to the second sheet conveying unit F2, for example.

Here, when the second sheet conveying unit F2 conveys the sheet P by the predetermined distance of X mm from the second sheet detection sensor SN2, a period during which the first sheet conveying unit F1 and the second sheet conveying unit F2 conveys the sheet P to the downstream side in the sheet conveying direction at substantially same speeds is referred to as a first period "a1" and a period from when the speed of the second sheet conveying unit F2 starts to decrease to when the second sheet conveying unit F2 stops is referred to as a second period "a2". In addition, a period during which the sheet P is stopped at the stop position ahead of the second sheet detection sensor SN2 by the predetermined distance of X mm due to the stoppage of the second sheet conveying unit F2 is referred to as a third period "b". At completion of the third period b, the fourth sheet conveying unit F4 starts the sheet folding operation to the sheet P. The second period a2 corresponds to a period from the timing T2 at which a control of stopping the second drive motor M2 is started to the timing T3 at which the control of stopping the second drive motor M2 is completed. During the second period a2, the sheet P bends between the first sheet conveying unit F1 and the second sheet conveying unit F2, a load variation influence is generated to the second drive motor M2, and therefore a deviation is generated between a target value of the distance of conveyance (depicted by a broken line in FIG. 13) and a measured value of the distance of conveyance (depicted by a solid line in FIG. 13).

It is to be noted that the "load variation influence" here is generated due to a bend or warp of the sheet P other than a sheet conveyance load of the sheet P, that is, transmitted a driving force from a sheet conveying member and is generated to a drive motor side as a load.

Specifically, the second drive motor M2 does not stop instantly and power transmission parts such as a timing belt have a time lag. Therefore, the second sheet conveying unit F2 completely stops at a timing with a delay from the stoppage of rotation of the second drive motor M2. In addition, when the second drive motor M2 stops or while the speed of the second sheet conveying unit F2 is decreasing, the second sheet conveying unit F2 is continuously applying the conveying force to the sheet P. Therefore, even when the speed of the second sheet conveying unit F2 is decreasing or even after the second sheet conveying unit F2 is stopped, the sheet P is pushed in the direction A due to the conveying force applied by the first sheet conveying unit F1. Consequently, even though the conveyance of the sheet P is forced to stop at the stop position by the distance of X mm from the second sheet detection sensor SN2 after the second sheet detection sensor SN2 has detected the leading end P1 of the sheet P, the stop position by the distance of X mm from the second sheet detection sensor SN2 is shifted due to the deviation indicated in the second period a2 in FIG. 13.

Specifically, a comparative sheet folding device employs a sheet holding and reversing method. That is, in the comparative folding device, one roller of one pair of sheet conveying members also functions as one of another pair of sheet conveying members. According to this configuration, the comparative sheet folding device can achieve a reduction in size but does not especially take a motor load into consideration. Specifically, when the comparative sheet folding device performs a sheet folding operation, the one pair of sheet conveying members are rotated in the reverse direction. Therefore, when the one pair of sheet conveying members are rotated in the reverse direction while holding a sheet therebetween, it is likely that the motor load significantly changes depending on paper size and thickness of the sheet. In a case in which the motor load significantly changes, amounts of conveyance of sheets vary due to the driving of the motor, and therefore it is likely that a sheet folding position at which the sheet is folded is shifted. It does not seem that the comparative sheet folding device gives any consideration to this inconvenience.

By contrast, in order to address changes in motor load that can cause variation in the amounts of conveyance, a different comparative sheet folding device employs a feedback control to control the driving of the motor, so that the sheet can be folded at a correct position.

However, in the technique of the different comparative sheet folding device, even though the feedback control is performed to correct the variation in amounts of conveyance of a drive motor, the control is performed to basically correct a speed of conveyance when the speed is shifted. By correcting the speed of conveyance of the sheet, the variation in amounts of conveyance can be corrected. However, the positional shift of a sheet to cause variation in amounts of conveyance is not directly corrected but the speed of conveyance of the sheet is controlled, thereby lacking the accuracy of correction of the positional shift.

In the comparative sheet folding device, the deviation is corrected by controlling the speed of conveyance of a sheet. However, it is difficult to reduce or eliminate the error (i.e., the deviation) the correction of speed cannot fully reduce or eliminate the error (i.e., the deviation) to a desired range.

In order to address this inconvenience, the sheet folding device 100 according to Embodiment 2 of this disclosure executes a proportional, integration and differential (PID) control in stopping of the second drive motor M2 to perform a correction of the position for correction of the amount of conveyance of the sheet P.

The PID control is preferable when employing a direct current (DC) motor as a drive motor to control an input value based on a deviation between an output value (an actual control value) and a target value (a desired set point), the integral, and the differential. The PID control is a control of combination of a proportional control (P), an integral control (I), and a differential control (D). The proportional control is a control performed in proportion to a difference (deviation) of the output value and the target value. The integral control is a control performed to eliminate or cancel the difference (deviation) of the output value and the target value. The differential control is a control performed to restrain conversion. At this time, for example, a deviation between a target speed and a measured speed is detected. To the detected speed deviation, calculation is conducted by the proportional (P), integral (I), and differential (D). By so doing, the PID control is performed.

In the present embodiment, based on the calculation result, the CPU 100*a* outputs a signal to output electricity for driving the DC motor, to a motor driver illustrated in FIG. 2, so as to execute the PID control to the drive motor. In the present embodiment, the PID control is performed by the CPU 100*a* but the configuration is not limited thereto. For example, a control integrated circuit (IC) such as an application specific integrated circuit (ASIC) can be applied to the PID control. The PID control employed to the configuration according to the present embodiment of this disclosure is a commonly known control technique. That is, the PID control is performed based on each setting value or parameter according to a target to control, in other words, according to a configuration and control conditions of a device or an apparatus.

In the present embodiment, the deviation generated in the second period a2 is canceled by the feedback control using an integral gain, that is, by the PID control. Specifically, variation in rotation of the second drive motor M2 that drives the second sheet conveying unit F2 is corrected by the PID control. By so doing, the variation in amounts of conveyance of a sheet is reduced to stop the second sheet conveying unit F2 at the position corresponding to the distance of X mm accurately, and therefore a highly accurate sheet folding quality can be secured.

Further, other elements or components and operations of the sheet folding device 100 according to the present embodiment of this disclosure are identical to those of the above-described sheet folding devices. By employing the PID control according to the present embodiment to the above-described techniques, the sheet folding operation including the half fold operation, the Z-fold operation, the letter fold-in operation, and the letter fold-out operation can be performed by the PID control accurately.

Figure 14:
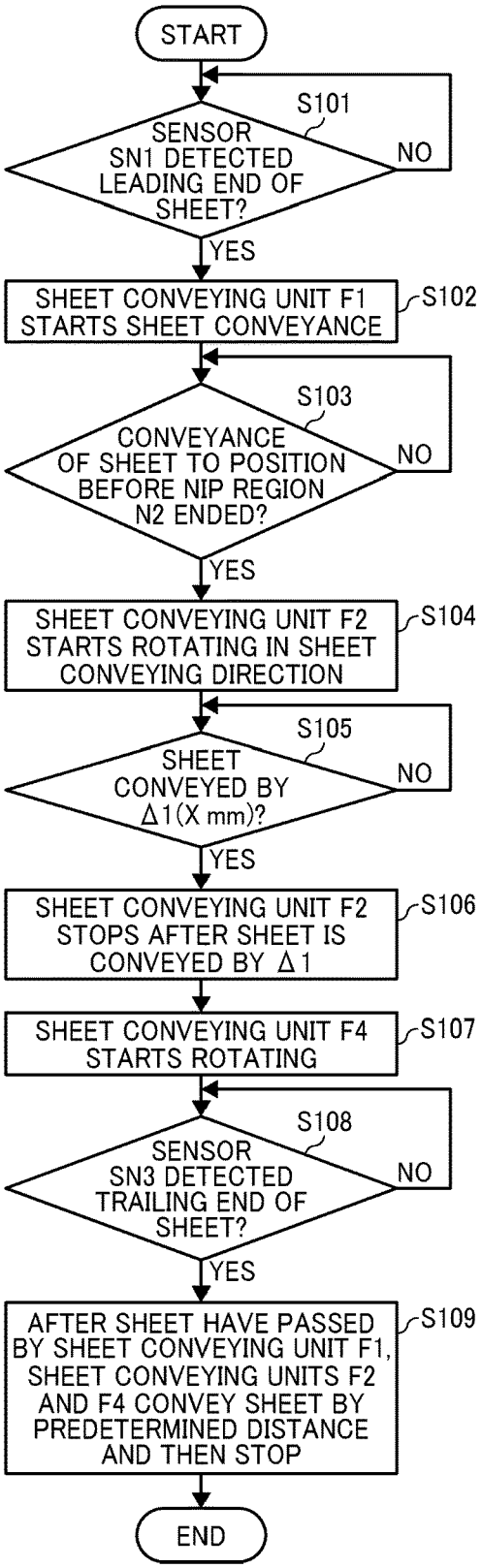
FIG. 14 is a flowchart illustrating a control procedure when performing the half fold operation according to Embodiment 2 of this disclosure.

FIG. 14 is a flowchart illustrating a control procedure when performing the half fold operation according to Embodiment 2 of this disclosure.

In the control procedure described in the flowchart of FIG. 14, it is determined whether or not the first sheet detection sensor SN1 detects the leading end of the sheet P, in step S101. When the leading end of the sheet P is detected by the first sheet detection sensor SN1 (YES in step S101), the first sheet conveying unit F1 starts conveyance of the sheet P, in step S102. When the leading end of the sheet P is not detected by the first sheet detection sensor SN1 (NO in step S101), the process returns to repeat step S101 until the leading end of the sheet P is detected by the first sheet detection sensor SN1.

After step S102, it is determined whether or not the leading end of the sheet P is conveyed to a point immediately before the second nip region N2 of the second sheet conveying unit F2, in step S103. When the leading end of the sheet P is conveyed to the point immediately before the second nip region N2 (YES in step S103), the second sheet conveying unit F2 starts rotating in the sheet conveying direction (i.e., the direction A), in step S104. When the leading end of the sheet P is not conveyed to the point immediately before the second nip region N2 (NO in step S103), the process returns to repeat step S103 until the leading end of the sheet P is conveyed to the point immediately before the second nip region N2.

After step S104, it is determined whether or not the sheet P is conveyed by the previously set amount of conveyance Δ1 (i.e., the distance of X mm), in step S105. When the sheet P is conveyed by the amount of conveyance Δ1 (YES in step S105), the second sheet conveying unit F2 stops rotating, in step S106. When the sheet P is not conveyed by the amount of conveyance Δ1 (NO in step S105), the process returns to repeat step S105 until the sheet P is conveyed by the amount of conveyance Δ1.

The PID control is executed while the sheet P is conveyed by the distance of X mm in step S105.

After the second sheet conveying unit F2 has been stopped in step S106, the fourth sheet conveying unit F4 starts rotating, in step S107.

As described above, the fold P2 of the sheet P is formed in the nip region formed between the third sheet conveying roller R4 and the fifth sheet conveying roller R7 of the fourth sheet conveying unit F4. The fold P2 is conveyed to the second pair of sheet conveying rollers R6 and is reinforced in the fifth nip region N5. Thereafter, the sheet P passes through the connecting sheet conveyance passage W2*d* that connects the second sheet conveyance passage W2 and the first sheet conveyance passage W1. Consequently, the sheet P is conveyed by the first sheet conveying unit F1 in the first sheet conveyance passage W1 to the second sheet conveying unit F2. After having been received by the second sheet conveying unit F2, the sheet P is further conveyed and ejected to the subsequent post-processing device 300.

At this time, it is determined whether or not the third sheet detection sensor SN3 detects the trailing end of the sheet P folded in two, in step S108. When the trailing end of the sheet P is detected by the third sheet detection sensor SN3 (YES in step S108) and has passed through the first sheet conveying unit F1, the second drive motor M2 and the fourth drive motor M4 are stopped, in step S109.

By repeating the above-described process, the half-fold sheets P are generated continuously.

Embodiment 3

Figure 15A:
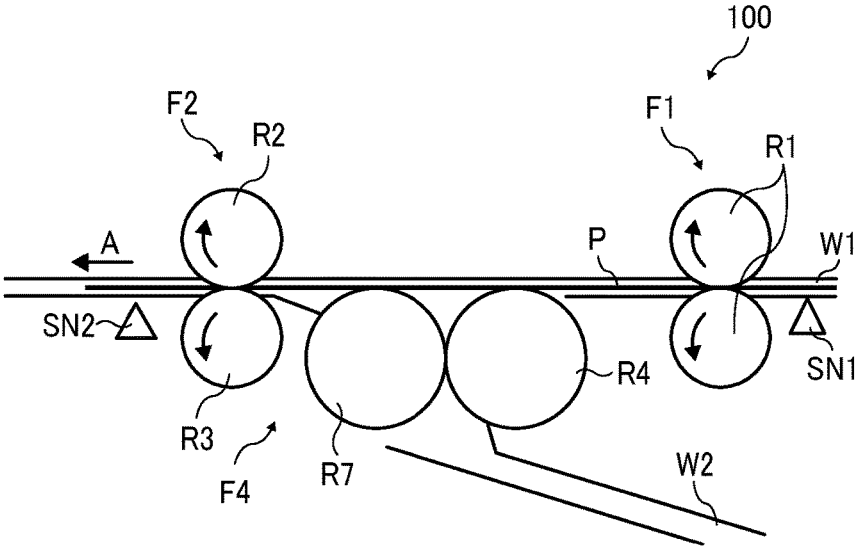
FIGS. 15A and 15B are diagrams illustrating a main part of a sheet folding mechanism according to Embodiment 3 of this disclosure, included in a sheet folding device according to Embodiment 3 of this disclosure, and a sheet folding operation performed by the sheet folding mechanism.
Figure 15B:
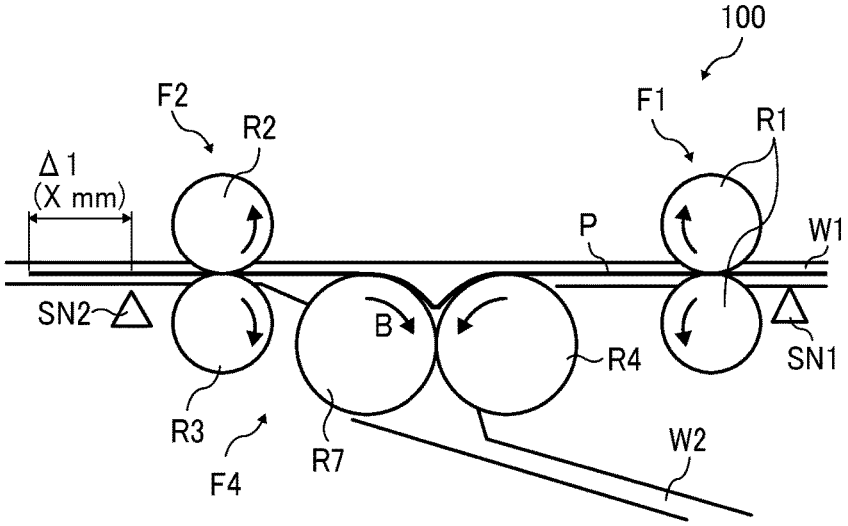

Now, a description is given of the sheet folding mechanism 50 according to Embodiment 3 of this disclosure, included in the sheet folding device 100 according to Embodiment 3 of this disclosure, with reference to FIGS. 15A and 15B.

In Embodiment 3, the sheet folding mechanism 50 performs a different sheet folding operation by a sheet folding control including the feedback control with the integral gain.

FIGS. 15A and 15B are diagrams illustrating a main part of the sheet folding mechanism 50 according to Embodiment 3 of this disclosure, included in the sheet folding device 100, and a sheet folding operation performed by the sheet folding mechanism 50 according to Embodiment 3 of this disclosure. Specifically, FIG. 15A is a diagram illustrating a state in which the sheet P is conveyed toward the downstream side of the first sheet conveyance passage W1. FIG. 15B is a diagram illustrating a state immediately after the start of the sheet folding operation.

It is to be noted that the elements or components of the sheet folding device 100 according to Embodiment 3 are identical to the elements or components of the sheet folding device 100 according to Embodiment 2, and therefore the descriptions thereof are omitted. Now, a description is given of the sheet folding operation according to Embodiment 3, with further reference to FIG. 16.

Figure 16:
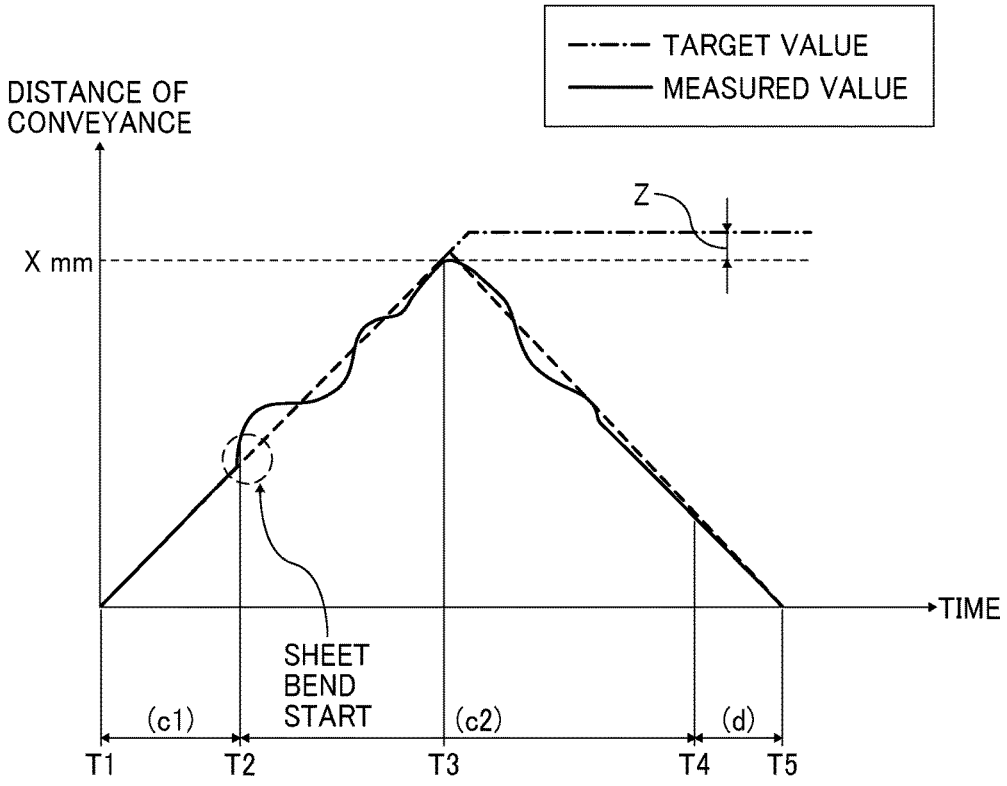
FIG. 16 is a diagram illustrating a relation of a time and a distance of conveyance of the sheet when performing the sheet folding operation according to Embodiment 3 of this disclosure.

FIG. 16 is a diagram illustrating a relation of a time and a distance of conveyance of the sheet P when performing the sheet folding operation according to Embodiment 3 of this disclosure.

As illustrated in FIG. 15A, the sheet folding mechanism 50 according to Embodiment 3 conveys the sheet P fed from the image forming apparatus 200, by the first sheet conveying unit F1 and the second sheet conveying unit F2 toward the downstream side in the direction A in FIG. 15A. The leading end of the sheet P is detected at the second sheet detection sensor SN2 at the timing T1. Then, the sheet P is conveyed by the predetermined amount of conveyance Δ1 (for example, a distance of X mm) at the timing T2. The second sheet conveying unit F2 is controlled to rotate in the reverse direction at the timing T3 at which the sheet P is conveyed by the distance of X mm. In synchronization with the reverse rotation of the second sheet conveying unit F2, the fourth sheet conveying unit F4 starts rotating in the direction B. After the reverse rotation of the second sheet conveying unit F2 has reached at a constant speed at a timing T4, the sheet P is conveyed by a predetermined amount. After the sheet P has passed through the second nip region N2 of the second sheet conveying unit F2, the fourth sheet conveying unit F4 stops the rotation at a timing T5.

According to the reverse rotation of the second sheet conveying unit F2, the half fold operation is performed to the sheet P. That is, as the second sheet conveying unit F2 rotates in the reverse direction, the directions of conveyance of the sheet P become opposite between the first sheet conveying unit F1 (the forward direction) and the second sheet conveying unit F2 (the reverse direction). As a result, the sheet P bends, as illustrated in FIG. 15B. That is, in a state in which the direction of the leading end of the sheet P is changed to a direction opposite the direction A, the first sheet conveying unit F1 conveys the sheet P further to the direction A. Therefore, since he direction of conveyance of the sheet P by the first sheet conveying unit F1 and the direction of conveyance of the sheet P by the second sheet conveying unit F2 become opposite, the sheet P bends or warps toward an open space.

At this time, the direction of rotation of the second drive motor M2 that drives the second sheet conveying unit F2 is reversed, the sheet P warps in the space immediately before the nip region formed between the third sheet conveying roller R4 and the fifth sheet conveying roller R7 of the fourth sheet conveying unit F4 (the pair of pair of sheet folding rollers), as illustrated in FIG. 15B. Further, the sheet P is guided and pushed by the first sheet conveying unit F1 and the second sheet conveying unit F2 to the nip region of the fourth sheet conveying unit F4, and therefore the sheet folding operation is performed to the sheet P. During this operation, the second sheet conveying unit F2 receives a force to the direction A by an elastic force applied by the warp of the sheet P and the conveying force applied by the first sheet conveying unit F1. Accordingly, a force to push the sheet P in the direction A in the second nip region N2 of the second sheet conveying unit F2.

Here, when the second sheet conveying unit F2 conveys the sheet P by the predetermined distance of X mm from the second sheet detection sensor SN2, a period during which the first sheet conveying unit F1 and the second sheet conveying unit F2 convey the sheet P to the downstream side in the sheet conveying direction at substantially same speeds is referred to as a first period "c1" and a period from when the speed of the second sheet conveying unit F2 starts to decrease to when the second sheet conveying unit F2 rotates in the reverse direction at a constant speed is referred to as a second period "c2". The second period c2 corresponds to a period from the timing T2 at which a control of stopping the second drive motor M2 is started to the timing T4 at which the reverse rotation of the second sheet conveying unit F2 has reached at a constant speed. During the second period c2, the sheet P bends between the first sheet conveying unit F1 and the second sheet conveying unit F2, a load variation influence is generated to the second drive motor M2 by the force to push the sheet P in the direction A in the second nip region N2 of the second sheet conveying unit F2, and therefore a deviation is generated between a target value of the distance of conveyance (depicted by a broken line in FIG. 16) and a measured value of the distance of conveyance (depicted by a solid line in FIG. 16). The third period d corresponds to a period from the timing T4 at which the reverse rotation of the second sheet conveying unit F2 has reached at a constant speed to the timing T5 at which the sheet P has passed through the second nip region N2 of the second sheet conveying unit F2 and the fourth sheet conveying unit F4 stops the rotation.

Specifically, even though the second drive motor M2 is rotated in the reverse direction, the second drive motor M2 does not stop instantly and power transmission parts such as a timing belt has a time lag and a backlash. Therefore, the rotation of the second sheet conveying unit F2 reaches a constant speed at a timing with a delay from the reverse rotation of the second drive motor M2. In addition, since the second sheet conveying unit F2 is rotated in the reverse direction after the stop state in Embodiment 2, when the second drive motor M2 stops or while the second sheet conveying unit F2 is decreasing in speed, the second sheet conveying unit F2 continuously applies the conveying force to the sheet P and an elastic force applied due to the warp of the sheet P also acts. Therefore, even when the second sheet conveying unit F2 is decreasing in speed or stopped, the sheet P is pushed in the direction A due to the conveying force applied by the first sheet conveying unit F1. Consequently, even though the conveyance of the sheet P is forced to stop at the position by the distance of X mm from the second sheet detection sensor SN2 after the second sheet detection sensor SN2 has detected the leading end of the sheet P, the position of the distance of X mm is shifted due to the deviation indicated by the second period c2 in FIG. 15. In FIG. 16, reference letter "Z" indicates a deviation in conveyance due to push-in of the sheet P.

It is to be noted that, as long as the second drive motor M2 is a DC motor, the second drive motor M2 can be rotated in the reverse direction without a settling time (the stopping time). However, the sheet folding operation delays due to the time lag or the backlash of the power transmission parts of the second sheet conveying unit F2.

Similar to Embodiment 2, the second drive motor M2 is rotated in the reverse direction during the second period c2 from the timing T2 to the timing T4 and the PID control with the integral gain is performed in Embodiment 3. Accordingly, the reverse rotation of the second drive motor M2 can reduce the deviation of conveyance Z due to excessive sheet conveyance generated by the backlash error that is caused by the push-in of the sheet by the first sheet conveying unit F1.

In FIG. 15B, the second sheet conveying unit F2 rotates in the reverse direction without the deviation of conveyance Z at the timing (T3) when the sheet P is conveyed further by the distance of X mm. Further, the deviation generated between the target value and the measured value is canceled by the PID control using an integral gain. Therefore, the variation in amount of conveyance of the sheet P by the second sheet conveying unit F2 can be reduced. Similarly in Embodiment 2, the PID control is performed based on each setting value or parameter according to a target to control, in other words, according to a configuration and control conditions of a device or an apparatus in Embodiment 3.

Further, by employing the PID control according to Embodiment 2 or Embodiment 3 to the configuration illustrated in FIG. 3, the sheet folding operation including the half fold operation, the Z-fold operation, the letter fold-in operation, and the letter fold-out operation can be performed by the PID control accurately.

Figure 17:
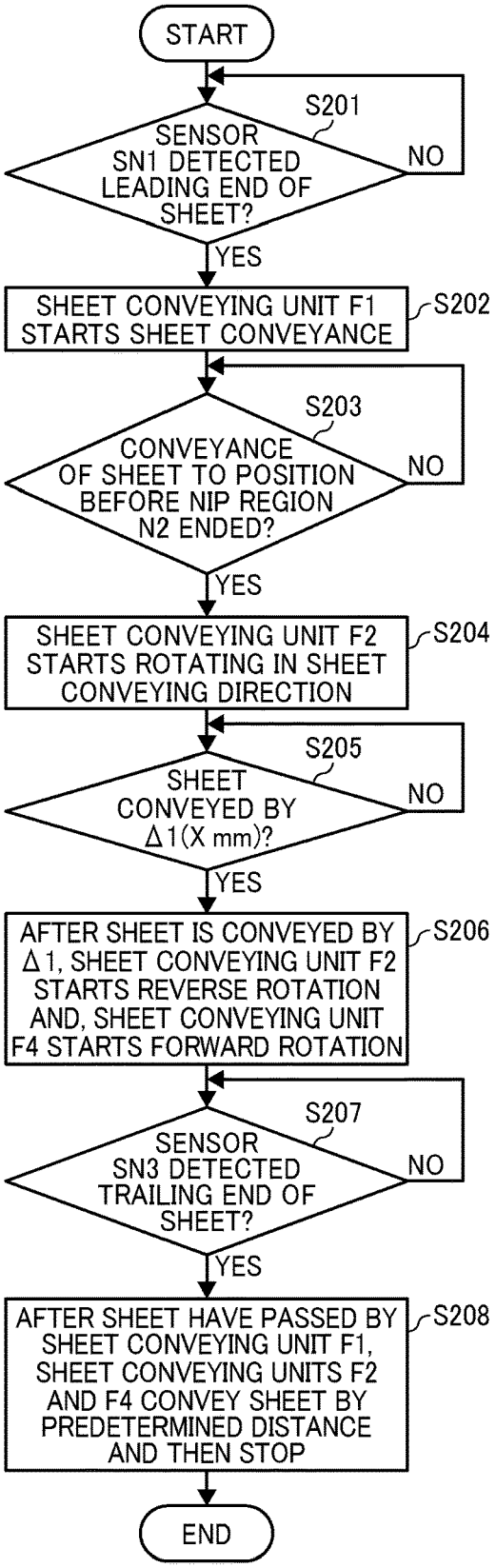
FIG. 17 is a flowchart illustrating an order of control when performing the half fold operation according to Embodiment 3 of this disclosure.

FIG. 17 is a flowchart illustrating a control procedure when performing the half fold operation according to Embodiment 3 of this disclosure.

In the control procedure described in the flowchart of FIG. 17, it is determined whether or not the first sheet detection sensor SN1 detects the leading end of the sheet P, in step S201. When the leading end of the sheet P is detected by the first sheet detection sensor SN1 (YES in step S201), the first sheet conveying unit F1 starts conveyance of the sheet P, in step S202. When the leading end of the sheet P is not detected by the first sheet detection sensor SN1 (NO in step S201), the process returns to repeat step S201 until the leading end of the sheet P is detected by the first sheet detection sensor SN1.

After step S202, it is determined whether or not the leading end of the sheet P is conveyed to a point immediately before the second nip region N2 of the second sheet conveying unit F2, in step S203. When the leading end of the sheet P is conveyed to the point immediately before the second nip region N2 (YES in step S203), the second sheet conveying unit F2 starts rotating in the sheet conveying direction (i.e., the direction A), in step S204. When the leading end of the sheet P is not conveyed to the point immediately before the second nip region N2 (NO in step S203), the process returns to repeat step S203 until the leading end of the sheet P is conveyed to the point immediately before the second nip region N2.

After step S204, it is determined whether or not the sheet P is conveyed by the previously set amount of conveyance Δ1 (i.e., the distance of X mm), in step S205. When the sheet P is conveyed by the amount of conveyance Δ1 (YES in step S205), the second sheet conveying unit F2 is rotated to the reverse direction and starts the fourth sheet conveying unit F4 to rotate, in step S06. When the sheet P is not conveyed by the amount of conveyance Δ1 (NO in step S205), the process returns to repeat step S205 until the sheet P is conveyed by the amount of conveyance Δ1.

As described above, the fold P2 of the sheet P is formed in the nip region formed between the third sheet conveying roller R4 and the fifth sheet conveying roller R7 of the fourth sheet conveying unit F4. The fold P2 is conveyed to the second pair of sheet conveying rollers R6 and is reinforced in the fifth nip region N5.

Thereafter, the sheet P passes through the connecting sheet conveyance passage W2*d* that connects the second sheet conveyance passage W2 and the first sheet conveyance passage W1. Consequently, the sheet P is conveyed by the first sheet conveying unit F1 in the first sheet conveyance passage W1 to the second sheet conveying unit F2. After having been received by the second sheet conveying unit F2, the sheet P is further conveyed and ejected to the subsequent post-processing device 300.

At this time, it is determined whether or not the third sheet detection sensor SN3 detects the trailing end of the sheet P folded in two, in step S207. When the trailing end of the sheet P is detected by the third sheet detection sensor SN3 (YES in step S207) and has passed through the first sheet conveying unit F1, the second drive motor M2 and the fourth drive motor M4 are stopped, in step S208.

By repeating the above-described process, the half-fold sheets P are generated continuously.

Further, in Embodiment 2 and Embodiment 3, the sheet folding device 100 includes the first drive motor M1, the second drive motor M2, and the fourth drive motor M4, and the PID control is applied to the second drive motor M2. In this configuration, the first drive motor M1 also receives a force in a direction opposite the direction A from the sheet P due to a reaction of the stop or the reverse rotation of the second drive motor M2. Therefore, it is preferable that the PID control is also applied to the first drive motor M1. Accordingly, the amount of conveyance on the push-in side of the sheet P can also be corrected.

Further, the fourth drive motor M4 also receives a force from the first drive motor M1 and the second drive motor M2 via the sheet P during the half fold operation. Therefore, it is preferable that the PID control is also applied to the fourth drive motor M4. Accordingly, the precision of the sheet folding position can be further enhanced.

In addition, in a case in which the PID control according to Embodiment 2 or Embodiment 3 is applied to the configuration illustrated in FIG. 3, when the same PID control is executed to the first drive motor M1, the second drive motor M2, and the third drive motor M3, the sheet folding operation including the half fold operation, the Z-fold operation, the letter fold-in operation, and the letter fold-out operation can be more highly accurate to the sheet folding position.

It is to be noted that, when the PID control relative to the first drive motor M1, the second drive motor M2, the third drive motor M3, and the fourth drive motor M4 is executed, individual parameters are set to achieve respective target amounts of conveyance of the sheet relative to the first drive motor M1, the second drive motor M2, the third drive motor M3, and the fourth drive motor M4 for correction.

Further, in Embodiments 1 through 3, the sheet folding device 100 includes the first the first drive motor M1, the second drive motor M2, the third drive motor M3, and the fourth drive motor M4, the second drive motor M2, and the fourth drive motor M4, as a DC motor respectively. By employing the DC motor, a higher resolution and a more detailed feedback control can be achieved.

Further, a motor step-out does not occur even when an abrupt load variation influence occurs, and the operation can start without setting the settling time (the stopping time) during a switching motion when the direction rotation changes from the normal rotation to the reverse rotation. Therefore, the productivity can be enhanced.

Further, the first sheet conveying unit F1 may include multiple first sheet conveying units F1. Similarly, the second sheet conveying unit F2 may include multiple second sheet conveying units F2. According to this configuration, multiple sheet folding operations such as a letter fold-in operation, a letter fold-out operation, and a Z-fold operation can be performed with a highly accurate sheet folding control, thereby achieving a highly accurate sheet folding quality.

The configurations according to the above-descried embodiments are not limited thereto. This disclosure can achieve the following aspects effectively.

Aspect 1.

In Aspect 1, a sheet folding device (for example, the sheet folding device 100) includes a first sheet conveyance passage (for example, the first sheet conveyance passage W1), a second sheet conveyance passage (for example, the second sheet conveyance passage W2), a first drive motor (for example, the first drive motor M1), a first sheet conveyor (for example, the first sheet conveying unit F1), a second drive motor (for example, the second drive motor M2), a second sheet conveyor (for example, the second sheet conveying unit F2), and a controller (for example, the CPU 100*a*). The first sheet conveyance passage is a passage through which a sheet (for example, the sheet P) travels. The second sheet conveyance passage is a passage through which the sheet conveyed from the first sheet conveyance passage travels. The first sheet conveyor is driven by the first drive motor. The first sheet conveyor is configured to receive the sheet and to convey the sheet toward a downstream side of a sheet conveying direction. The second sheet conveyor is driven by the second drive motor. The second sheet conveyor is configured to receive the sheet conveyed from the first sheet conveyor and to convey the sheet further to the downstream side of the sheet conveying direction. The controller is configured to fold the sheet to a predetermined folding length set according to an amount of conveyance of the sheet by the second sheet conveyor while the sheet is being held between the first sheet conveyor and the second sheet conveyor, and to perform a feedback control with an integral gain to the second drive motor.

According to this configuration, as described in the above-described embodiment, the amount of conveyance of the sheet P performed by the second sheet conveyor can be corrected by correcting the position of the sheet P using the feedback control with the integral gain.

As described above, in the above-described embodiments, the positional shift is not corrected based on the speed control but is directly corrected. Accordingly, when compared with a configuration in which the positional shift is corrected based on the speed control, a correction precision of the positional shift can be more enhanced. As described above, in the above-described embodiments, the positional shift is not corrected based on the speed control but is directly corrected. Accordingly, when compared with a configuration in which the positional shift is corrected based on the speed control, a correction precision of the positional shift can be more enhanced.

Aspect 2.

In Aspect 1, the second sheet conveyor (for example, the second sheet conveying unit F2) is configured to rotate in either direction.

According to this configuration, as described in the above-described embodiment, the reverse rotation of the second drive motor M2 can reduce the backlash error of power transmission parts of the second sheet conveyor.

Aspect 3.

In Aspect 1, the first sheet conveyor (for example, the first sheet conveying unit F1) includes multiple first sheet conveyors and the second sheet conveyor (for example, the second sheet conveying unit F2) includes multiple second sheet conveyors.

According to this configuration, as described in the above-described embodiment, multiple sheet folding operation s such as a letter fold-in operation, a letter fold-out operation, and a Z-fold operation can be performed with a highly accurate sheet folding control, thereby achieving a highly accurate sheet folding quality.

Aspect 4.

In Aspect 1, the controller (for example, the CPU 100*a*) is configured to control the first drive motor (for example, the first drive motor M1) and the second drive motor (for example, the second drive motor M2) and to perform the feedback control with the integral gain to the first drive motor.

According to this configuration, as described in the above-described embodiment, since the feedback control with the integral gain is also applied to the driving of the first sheet conveyor (for example, the first sheet conveying unit F1), the amount of conveyance of the sheet (for example, the sheet P) by the first sheet conveyor can be corrected accurately, thereby achieving a more highly accurate sheet folding quality.

Aspect 5.

In any one of Aspect 1 through Aspect 4, the first drive motor (for example, the first drive motor M1) and the second drive motor (for example, the second drive motor M2) include a DC motor.

According to this configuration, as described in the above-described embodiment, a higher resolution and a more detailed feedback control can be achieved. Therefore, even when an abrupt load variation influence occurs, a motor step-out can be prevented.

Aspect 6.

In any one of Aspect 1 through Aspect 5, an image forming system (for example, the image forming system 1) includes an image forming apparatus (for example, the image forming apparatus 200) configured to form an image on the sheet, and the sheet folding device (for example, the sheet folding device 100) configured to fold the sheet having the image formed by the image forming apparatus.

According to this configuration, the image forming system having the effects described above can be provided.

Aspect 7.

In Aspect 6, the sheet folding device is disposed in an apparatus body of the image forming apparatus (for example, the image forming apparatus 200).

According to this configuration, the image forming apparatus can be reduced in size, thereby enhancing a space saving of the image forming system.

Aspect 8.

A sheet folding method used in the sheet folding device (for example, the sheet folding device 100) included in the image forming system (for example, the image forming system 1). The sheet folding method performs steps of receiving a sheet (for example, the sheet P), conveying the sheet toward a downstream side of a sheet conveying direction, subsequently conveying the sheet further to the downstream side of the sheet conveying direction, holding the sheet between two rollers disposed facing each other, setting a predetermined folding length of the sheet according to an amount of conveyance of the sheet by the subsequently conveying while the holding is conducted, folding the sheet to the predetermined folding length of the sheet, and performing a feedback control with an integral gain.

Accordingly, the feedback control using the integral gain can be applied to the amount of conveyance of the sheet by the second sheet conveyor (for example, the second sheet conveying unit F2) to perform a positional correction control.

In this case, since the positional shift is directly corrected, a correction precision can be more enhanced when compared with a case in which the positional shift is corrected based on the speed control.

As described above, this disclosure employs a feedback control with an integral gain as a motor control when performing the sheet folding operation using a sheet holding and reversing method, thereby correcting variation in rotation of a motor due to load variation influence. When the sheet folding operation is performed, a motor load increases due to conveyance of a folded sheet. However, by correcting the variation in rotation of the motor due to the increase in the motor load, variation in amounts of conveyance of sheets is reduced, and therefore a highly accurate sheet folding quality can be secured.

As described above, this disclosure employs a feedback control with an integral gain as a motor control when performing the sheet folding operation using a sheet holding and reversing method, thereby correcting variation in rotation of a motor due to load variation influence. When the sheet folding operation is performed, a motor load increases due to conveyance of a folded sheet. However, by correcting the variation in rotation of the motor due to the increase in the motor load, variation in amounts of conveyance of sheets is reduced, and therefore a highly accurate sheet folding quality can be secured.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet folding device comprising:

a first drive motor;

a first sheet conveyor drivable by the first drive motor, the first sheet conveyor configured to receive a sheet and configured to convey the sheet toward a downstream side of a sheet conveying direction;

a second drive motor;

a second sheet conveyor drivable by the second drive motor, the second sheet conveyor configured to receive the sheet conveyed from the first sheet conveyor and configured to convey the sheet further to the downstream side of the sheet conveying direction; and a controller configured to control the second drive motor to rotate the second sheet conveyor in a reverse direction and fold the sheet to a folding length set according to an amount of conveyance of the sheet by the second sheet conveyor while the sheet is being held between the first sheet conveyor and the second sheet conveyor, the controller being configured to perform a feedback control with an integral gain to control the second drive motor.

2. The sheet folding device according to claim 1, wherein the second sheet conveyor is configured to rotate in either the sheet conveying direction or the reverse direction.

3. The sheet folding device according to claim 1, wherein the first sheet conveyor includes multiple first sheet conveyors and the second sheet conveyor includes multiple second sheet conveyors.

4. The sheet folding device according to claim 1, wherein the controller is configured to control the first drive motor and the second drive motor and to perform the feedback control with the integral gain to the first drive motor.

5. The sheet folding device according to claim 1, wherein the first drive motor includes a DC motor and the second drive motor includes a DC motor.

6. An image forming system comprising:

an image forming apparatus configured to form an image on the sheet; and the sheet folding device according to claim 1, configured to fold the sheet having the image formed by the image forming apparatus.

7. The image forming system according to claim 6, wherein the sheet folding device is disposed in an apparatus body of the image forming apparatus.

8. The sheet folding device according to claim 1, wherein, upon detection of a leading end of the sheet, the second drive motor is configured to convey the sheet by a set amount of conveyance.

9. The sheet folding device according to claim 8, wherein, upon the sheet being conveyed by the set amount of conveyance, conveyance of the sheet is temporarily stopped for folding.

10. The sheet folding device according to claim 9, wherein, after the conveyance of the sheet is temporarily stopped, the first sheet conveyor and the second sheet conveyor are rotated in a reverse direction.

11. The sheet folding device according to claim 8, wherein the amount of conveyance is set based upon a calculation based on a length of the sheet conveyed in the sheet conveying direction or based on a table including relationships between of sheet size and amounts of sheet movement.

12. The sheet folding device according to claim 1, wherein the controller being configured to perform a feedback control with an integral gain is configured to control variation in rotation of the second drive motor by the feedback control using the integral gain.

13. The sheet folding device of claim 1, wherein variation between a target value and a measured value of the amount of conveyance is canceled by the feedback control using the integral gain.

14. A sheet folding method, comprising:

conveying the sheet by a first sheet conveyor, driven by a first motor, toward a downstream side of a sheet conveying direction;

receiving the sheet conveyed from the first sheet conveyor;

conveying the sheet by a second sheet conveyor, driven by a second motor, toward the downstream side of the sheet conveying direction;

setting a folding length of the sheet according to an amount of conveyance of the sheet conveyed by the second sheet conveyor while holding the sheet by the first sheet conveyor and the second sheet conveyor;

performing a feedback control with an integral gain to control the second motor to rotate the second sheet conveyor in a reverse direction; and folding the sheet to the folding length set.

15. The sheet folding method according to claim 14, wherein, upon detection of a leading end of the sheet, the second drive motor is configured to convey the sheet by a set amount of conveyance.

16. The sheet folding method according to claim 15, wherein the amount of conveyance is set based upon a calculation based on a length of the sheet conveyed in the sheet conveying direction or based on a table including relationships between of sheet size and amounts of sheet movement.

17. The sheet folding method according to claim 14, wherein the performing of the feedback control with an integral gain controls variation in rotation of the second drive motor by the feedback control using the integral gain.

18. The sheet folding method according to claim 14, wherein variation between a target value and a measured value of the amount of conveyance is canceled by the feedback control using the integral gain.

19. A sheet folding device comprising:

a first drive motor;

a first sheet conveyor drivable by the first drive motor, the first sheet conveyor configured to receive a sheet and configured to convey the sheet toward a downstream side of a sheet conveying direction;

a second drive motor;

a second sheet conveyor drivable by the second drive motor, the second sheet conveyor configured to receive the sheet conveyed from the first sheet conveyor and configured to convey the sheet further to the downstream side of the sheet conveying direction;

a third drive motor;

a third sheet conveyor drivable by the third drive motor; and a controller configured to stop the second drive motor and configured to rotate the third sheet conveyor and fold the sheet to a folding length set according to an amount of conveyance of the sheet by the second sheet conveyor while the sheet is being held between the first sheet conveyor and the second sheet conveyor, the controller being configured to perform a feedback control with an integral gain to control the third drive motor.

20. An image forming system comprising:

an image forming apparatus configured to form an image on the sheet; and the sheet folding device according to claim 19, configured to fold the sheet having the image formed by the image forming apparatus.

21. The sheet folding device of claim 19, wherein variation between a target value and a measured value of the amount of conveyance is canceled by the feedback control using the integral gain.

22. An image forming system comprising:

an image forming apparatus configured to form an image on the sheet; and the sheet folding device according to claim 21, configured to fold the sheet having the image formed by the image forming apparatus.

* * * * *